US009390686B2

(12) United States Patent
Inada et al.

(10) Patent No.: US 9,390,686 B2
(45) Date of Patent: Jul. 12, 2016

(54) DISPLAY DEVICE AND METHOD FOR DRIVING THE SAME

(71) Applicant: Sharp Kabushiki Kaisha, Osaka-shi, Osaka (JP)

(72) Inventors: Ken Inada, Osaka (JP); Taketoshi Nakano, Osaka (JP); Akizumi Fujioka, Osaka (JP); Kazuki Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 18 days.

(21) Appl. No.: 14/428,010

(22) PCT Filed: Jul. 26, 2013

(86) PCT No.: PCT/JP2013/070392

§ 371 (c)(1),
(2) Date: Mar. 13, 2015

(87) PCT Pub. No.: WO2014/050291

PCT Pub. Date: Apr. 3, 2014

(65) Prior Publication Data

US 2015/0255040 A1 Sep. 10, 2015

(30) Foreign Application Priority Data

Sep. 26, 2012 (JP) ..... 2012-211741

(51) Int. Cl.

| | |
|---|---|
| ***G09G 5/18*** | (2006.01) |
| ***G09G 3/36*** | (2006.01) |
| ***G09G 5/02*** | (2006.01) |

(52) U.S. Cl.

CPC ..... *G09G 5/18* (2013.01); *G09G 3/3611* (2013.01); *G09G 3/3614* (2013.01); *G09G 5/02* (2013.01); *G09G 2310/0202* (2013.01); *G09G 2310/04* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 6,483,492 | B1 | 11/2002 | Takeuchi et al. | |
| 2002/0180673 | A1 | 12/2002 | Tsuda et al. | |
| 2008/0224980 | A1 | 9/2008 | Senda et al. | |
| 2011/0255778 | A1 * | 10/2011 | Hashimoto ..... | G09G 3/3607 382/166 |

FOREIGN PATENT DOCUMENTS

| | | | |
|---|---|---|---|
| JP | 2001-312253 | A | 11/2001 |
| JP | 2004-185025 | A | 7/2004 |
| JP | 2005-140959 | A | 6/2005 |
| JP | 2011-221441 | A | 11/2011 |
| KR | 10-2008-0084081 | A | 9/2008 |

* cited by examiner

*Primary Examiner* — Kenneth B Lee, Jr.
(74) *Attorney, Agent, or Firm* — Keating & Bennett, LLP

(57) ABSTRACT

There is provided a display device capable of suppressing brightness change which can occur at the time of image update in intermission driving. A display control circuit (20) includes a frame memory (101), a coercive refreshing determination section (104), a refreshing circuit (105), and an undershoot circuit (106). The coercive refreshing determination section (104) outputs an active coercive refreshing signal and an active correction instruction signal upon determining that an image is updated. The refreshing circuit (105) receives the active coercive refreshing signal, and then outputs an active output control signal. The frame memory (101) receives the active output control signal, and then outputs an image data. The undershoot circuit (106) performs, if in reception of the active correction instruction signal, a correction by making a subtracting operation to the image data received from the frame memory (101), and then outputs corrected image data.

16 Claims, 15 Drawing Sheets

DISPLAY DEVICE AND METHOD FOR DRIVING THE SAME

TECHNICAL FIELD

The present invention relates to display devices, and more particularly to a display device which performs intermission driving, and a method of driving the same.

BACKGROUND ART

Rigorous efforts are underway in recent years for development of light and compact electronic devices. Such electronic devices require liquid crystal display devices of low power consumption. For reduced power consumption of liquid crystal display devices, intermission driving is proposed as a promising technique. A liquid crystal display device which performs intermission driving alternately repeats a drive period for scanning lines and writing data voltage thereby refreshing an image, and an intermission period for bringing all the scanning lines into a de-selected state thereby stopping the writing of data voltage. In the intermission period, a voltage applied to a liquid crystal layer in each pixel formation portion during an immediately preceding drive period (hereinafter called "liquid crystal application voltage") is maintained, so the displayed image is maintained. Hence, during the intermission period, operation of a gate driver and/or of a source driver can be stopped and therefore it is possible to reduce power consumption. Patent Literature 1, for example, discloses a liquid crystal display device which performs such an intermission driving as described above.

The liquid crystal display device uses a liquid crystal panel, which is composed of two electrode panels sandwiching a liquid crystal layer in between. As a voltage is applied to the liquid crystal layer, liquid crystal molecules in the liquid crystal layer change their alignment direction (orientation of the long axis) due to dielectric constant anisotropy of the liquid crystal. As the liquid crystal molecules change their alignment direction, light which passes through the liquid crystal layer is polarized in a different direction. It is possible, using this principle, to control the amount of light which passes through the liquid crystal layer by controlling the voltage applied to the liquid crystal layer. Therefore it is possible to control brightness of each pixel formation portion to a desired gradation level, and thereby display an image in the liquid crystal panel. The liquid crystal layer is sandwiched by two electrodes, one of which is a pixel electrode which is supplied with the data voltage via a thin film transistor (TFT) while the other of the electrodes sandwiching the liquid crystal layer is a common electrode, which is supplied with a common voltage that is common to all of the pixel formation portions. The common voltage is a voltage which is used as a baseline for the liquid crystal application voltage in the liquid crystal display device.

LIST OF REFERENCES

Patent Literature

PATENT LITERATURE 1: Japanese Unexamined Patent Application Publication No. 2001-312253

SUMMARY OF THE INVENTION

Problems to be Solved by the Invention

For example, in an intermission driving in which screen refreshing is performed at a refreshing rate of 1 Hz, the refreshing takes place only once in one second. Under this configuration, if the image is updated during the intermission period, it is likely that the updated image is discarded and is not displayed. To avoid this, there is an arrangement that upon an image update during an intermission period, a screen refreshing is performed coercively. In the present DESCRIPTION, refreshing which is performed in a predetermined cycle will be called "counter refreshing" whereas refreshing which is performed coercively when there in an update of image during an intermission period will be called "coercive refreshing". Also, a period from a starting point of a drive period in which a counter refreshing is performed to a starting point of a drive period in which the next counter refreshing is performed will be called "intermission driving cycle".

In liquid crystal display devices, the liquid crystal layer will deteriorate due to burning if voltages of the same polarity are continuously applied to the liquid crystal layer. In order to prevent the deterioration of liquid crystal layer, AC driving is employed in liquid crystal display devices for balanced liquid crystal application voltage polarity. Here, a consideration will be made for a liquid crystal display device which performs intermission driving based on AC driving. FIG. 15 is for describing an intermission driving based on AC driving performed by a conventional liquid crystal display device. In the following, description will be made with a focus on the smallest unit of an image displayed in a liquid crystal display device, i.e., one pixel (which represents one sub-pixel in a color image, but hereinafter, the unit will be called "one pixel" regardless of whether the displayed image is monochrome or colored). In the present DESCRIPTION, such one pixel onto which the description is focused will be called "focus pixel". In FIG. 15, the vertical axis and the horizontal axis represent data voltage and time respectively. As shown in FIG. 15, in order to achieve the balanced liquid crystal application voltage polarity, data voltage polarity is inverted for every counter refreshing, whereas in coercive refreshings, data voltage polarity is the same as in the immediately preceding counter refreshing. Specifically, in the first through the fourth intermission driving cycles, data voltages which are written to the pixel formation portion during the counter refreshing have positive polarity, negative polarity, positive polarity, and then negative polarity respectively. Therefore, in the respective counter refreshings during the first through the fourth intermission driving cycle, liquid crystal application voltages which are applied to the liquid crystal layer respectively have positive polarity, negative polarity, positive polarity, and negative polarity.

In the third intermission driving cycle, a coercive refreshing is performed during the intermission period in the same fashion as the counter refreshing during the third intermission driving cycle, i.e., a positive-polarity data voltage is used for the writing. It is now assumed that in the image update in the third intermission driving cycle, the focus pixel does not have a change in its gradation value while other pixels have changes in their gradation values. In the present DESCRIPTION, a pixel (sub-pixel in case of a color image) which does not experience a change in gradation value by an image update will be called "unchanged pixel" whereas a pixel which experiences a change in gradation value by the image update will be called "changed pixel". The focus pixel in FIG. 15 is an unchanged pixel. Therefore, in the coercive refreshing during the third intermission driving cycle, a data voltage which has the same magnitude as the one used in the counter refreshing during the third intermission driving cycle is written to the pixel formation portion. So, in the coercive refreshing during the third intermission driving cycle, a liquid crystal application voltage which has the same magnitude as the one used in the counter refreshing during the third intermission driving cycle is applied to the liquid crystal layer. As understood, at the time of coercive refreshing in the third intermission driving cycle, a data voltage which has the same polarity and the same magnitude as of a data voltage which was written at the time of the counter refreshing in the third intermission driving cycle is written to the pixel formation portion.

FIG. 16 shows how a liquid crystal application voltage (absolute value) and brightness change in the intermission driving shown in FIG. 15. Assume that a normally-black method is utilized in the liquid crystal panel. Note that in FIG. 16, a period from the second counter refreshing from the left to the third counter refreshing from the left corresponds to the third intermission driving cycle in FIG. 15. As shown in FIG. 16, the liquid crystal application voltage increases when a data voltage is written to the pixel formation portion at the time of refreshing, and then decreases as time passes during the intermission period. This is due to a change in the dielectric constant resulting from responses by the liquid crystals. It should be noted here that in the present DESCRIPTION, the expression "liquid crystal application voltage increases or decreases" means that "the absolute value of the liquid crystal application voltage increases or decreases". In cases where an image is not updated, change in the liquid crystal application voltage during that intermission driving cycle is substantially the same as changes during the other intermission driving cycles, and therefore an effective value of the liquid crystal application voltage is also substantially the same. Thus, the brightness is substantially consistent throughout all the intermission driving cycles if there is no image update. On the contrary, in cases where there is an image update (but the focus pixel does not have its gradation value changed as described), the liquid crystal application voltage increases as a data voltage is written in the counter refreshing; then the liquid crystal application voltage begins decreasing as time passes; but on its way down, a coercive refreshing takes place. Since the coercive refreshing makes writing of a data voltage which has the same polarity and the same magnitude as the one used for the counter refreshing, the liquid crystal application voltage increases again. For this reason, in an intermission driving cycle in which the image is updated, the liquid crystal application voltage has a greater effective value than in intermission driving cycles in which the image is not updated, by a value represented by a hatched area in FIG. 16. As a result, an unintended brightness change takes place. Specifically, as shown in FIG. 16, an unintended brightness increase takes place. It should be noted here that in cases where the liquid crystal panel utilizes a normally-white method, then the brightness change to the liquid crystal application voltage takes place in the inversed pattern, so there is an unintended decrease in the brightness.

It is therefore an object of the present invention to provide a display device capable of suppressing the brightness change which can occur at the time of image update in intermission driving, and to provide a method of driving the display device.

Solutions to the Problem

A first aspect of the present invention provides a display device which includes a display section having pixel formation portions, and performs an intermission driving of alternately repeating: a drive period for refreshing a screen of the display section by writing data voltages which are based on externally received image data to the pixel formation portions; and an intermission period for stopping writing of the data voltages to the pixel formation portions.

The display device further includes: a driving section configured to write the data voltages to the pixel formation portions; and a display controller configured to provide the drive period at a predetermined timing, and control the driving section so that, when an image represented by the externally received image data is updated during the intermission period, the intermission period is aborted and the drive period is performed coercively. In this display device, the display controller includes:

a polarity instruction section configured to control the driving section so that the data voltages in the coercively provided drive period have the same polarity as of the data voltages in an immediately preceding drive period; and a gradation correction section configured to: receive at least part of the image data; correct pixel gradation values for those pixels which constitute the image which is updated during the intermission period but do not have their gradation values changed due to the image update, so that data voltages to be written to their pixel formation portions in the coercively provided drive period have values closer to a baseline common voltage than do data voltages written to said pixel formation portions in an immediately preceding drive period; and output at least part of corrected image data. In this arrangement described above:

The driving section writes to the pixel formation portions data voltages which are based on at least part of the corrected image data that have undergone the gradation value correction made by the gradation correction section, in the coercively provided drive period.

A second aspect of the present invention provides the first aspect of the present invention, and in this arrangement:

The gradation correction section receives the image data; corrects pixel gradation values for those pixels which constitute the image updated during the intermission period but do not have their gradation values changed by the image update so that data voltages to be written to their pixel formation portions in the coercively provided drive period have values closer to the common voltage than do data voltages written to said pixel formation portions in an immediately preceding drive period; and outputs corrected image data. Further:

The driving section writes to the pixel formation portions data voltages which are based on the image data that have undergone the gradation value correction made by the gradation correction section, in the coercively provided drive period.

A third aspect of the present invention provides the second aspect of the present invention, and in this arrangement:

The display controller further includes:

an image data storage section configured to store externally received one frameful of image data;

a first refreshing controller configured to output an active first refreshing signal and an active polarity inversion signal at the predetermined timing; and a refreshing section configured to cause output of image data stored in the image data storage section, from the image data storage section to the gradation correction section based on the active first refreshing signal. In the arrangement described above:

The gradation correction section outputs the image data outputted from the image data storage section based on the active first refreshing signal, without correcting gradation values, and the polarity instruction section causes the driving section to invert the data voltage polarity based on the active polarity inversion signal.

A fourth aspect of the present invention provides the third aspect of the present invention, and in this arrangement:

The display controller further includes:

a second refreshing controller configured to output an active second refreshing signal and an active correction instruction signal when an image represented by externally received image data is updated during the intermission period. In the arrangement described above:

The refreshing section causes output of image data stored in the image data storage section, from the image data storage section to the gradation correction section based on the active second refreshing signal, and the gradation correction section corrects gradation values of the image data received from the image data storage section, based on the active correction instruction signal.

A fifth aspect of the present invention provides the fourth aspect of the present invention, and in this arrangement:

The display controller includes:

an image information obtaining section configured to obtain information of an image represented by externally received one frameful of image data, and output the obtained information of the image; and an image information storage section configured to store the information of the image obtained by the image information obtaining section. In the arrangement described above:

The second refreshing controller compares the information of the image in a current frame obtained by the image information obtaining section and the information of the image in a previous frame stored in the image information storage section to each other, and outputs the active second refreshing signal if the information of the image in the current frame differs from the information of the image in the previous frame.

A sixth aspect of the present invention provides the fifth aspect of the present invention, and in this arrangement:

The image information obtaining section takes a sum of gradation values in externally received one frameful of image data, as the information of the image.

A seventh aspect of the present invention provides the fifth aspect of the present invention, and in this arrangement:

The image information obtaining section takes a histogram of gradation values in externally received one frameful of image data, as the information of the image.

An eighth aspect of the present invention provides the fifth aspect of the present invention, and in this arrangement:

The image information obtaining section takes externally received one frameful of image data, as the information of the image.

A ninth aspect of the present invention provides the third aspect of the present invention, and in this arrangement:

The first refreshing controller determines the predetermined timing based on an externally received synchronization signal.

A tenth aspect of the present invention provides the third aspect of the present invention, and in this arrangement:

The display controller receives the image data externally only at a time of image update.

An eleventh aspect of the present invention provides the tenth aspect of the present invention, and in this arrangement:

The first refreshing controller internally generates a clock signal, and determines the predetermined timing based on the clock signal.

A twelfth aspect of the present invention provides the third aspect of the present invention, and in this arrangement:

The gradation correction section receives the image data externally in the coercively provided drive period.

A thirteenth aspect of the present invention provides the first aspect of the present invention, and in this arrangement:

The display controller controls the driving section, when part of an image represented by externally received image data is updated during the intermission period, so as to abort the intermission period in an updated region which includes the updated part and provide the drive period coercively;

the gradation correction section receives a portion of the image data which represents the updated region; corrects pixel gradation values for those pixels included in the updated region but not having their gradation values changed by the image update so that data voltages to be written to their pixel formation portions in the coercively provided drive period have values closer to the common voltage than do data voltages written to said pixel formation portions in an immediately preceding drive period; and outputs corrected data that represent the updated region; and the driving section writes to the pixel formation portions data voltages which are based on data which represent the updated region and have undergone the gradation value correction made by the gradation correction section, in the coercively provided drive period.

A fourteenth aspect of the present invention provides the thirteenth aspect of the present invention, and in this arrangement:

The display controller further includes:

an image data storage section configured to store externally received one frameful of image data;

a first refreshing controller configured to output an active first refreshing signal and an active polarity inversion signal at the predetermined timing; and a refreshing section configured to cause output of image data stored in the image data storage section, from the image data storage section to the gradation correction section based on the active first refreshing signal. In the above arrangement:

The gradation correction section outputs the image data outputted from the image data storage section based on the active first refreshing signal, without correcting gradation values, and the polarity instruction section causes the driving section to invert the data voltage polarity based on the active polarity inversion signal.

A fifteenth aspect of the present invention provides the fourteenth aspect of the present invention, and in this arrangement:

The display controller further includes a second refreshing controller configured to output an active second refreshing signal and an active correction instruction signal when the part of the image represented by externally received image data is updated during the intermission period. In the arrangement described above:

The refreshing section causes output of data which represents the updated region and is part of the image data stored in the image data storage section, from the image data storage section to the gradation correction section based on the active second refreshing signal; and the gradation correction section corrects gradation values of the data which represents the updated region and is received from the image data storage section, based on the active correction instruction signal.

A sixteenth aspect of the present invention provides a driving method of a display device which comprises a display section including pixel formation portions, and performs an intermission driving of alternately repeating a drive period for refreshing a screen of the display section by writing data voltages which are based on externally received image data to the pixel formation portions, and an intermission period for stopping writing of the data voltages to the pixel formation portions. The method includes: a writing step of aborting the intermission period and providing the drive period coercively when an image represented by externally received image data is updated during the intermission period, thereby writing the data voltages to the pixel formation portions in the coercively provided drive period, with a same data voltage polarity as in an immediately preceding drive period; and a gradation correction step of receiving at least part of the image data; correcting pixel gradation values for those pixels which constitute the image which is updated during the intermission period but do not have their gradation values changed due to the image update, so that data voltages to be written to their pixel formation portions in the coercively provided drive period have values closer to a baseline common voltage than do data voltages written to said pixel formation portions in an immediately preceding drive period; and outputting at least part of corrected image data. In this method:

In the writing step, to the pixel formation portions are written data voltages which are based on at least part of the corrected image data that have undergone the gradation value correction made in the gradation correction step.

Advantages of the Invention

According to the first aspect of the present invention, in a display device which performs intermission driving, pixel formation portions which form pixels whose gradation values are not changed by the image update are supplied, by writing in a coercively provided drive period, with data voltages that have the same polarity as of data voltages written in the immediately preceding drive period but have values closer to the common voltage than values of the data voltages written in the immediately preceding drive period. This reduces increase in pixel formation portion application voltage (or liquid crystal application voltage if the display device is provided by a liquid crystal display device) at the time of a coercively provided drive period, and therefore also reduces increase in pixel formation portion application voltage effective value. This makes it possible to suppress potential brightness change at the time of image update.

According to the second aspect of the present invention, the drive period and the intermission period are provided universally across the screen, and the same advantages are offered as does the first aspect of the present invention.

According to the third aspect of the present invention, it is possible to perform refreshing by following the first refreshing signal thereby writing to pixel formation portions data voltages which are based on image data stored in the frame memory in the drive period provided at the predetermined timing. This makes it possible to periodically bring the pixel formation portion application voltages, which change with time during the intermission period, back to the original values. This keeps the image displayed in the screen. It is also possible to ensure polarity balance by determining data voltage polarity based on the polarity inversion signal, for each drive period which is provided at the predetermined timing.

According to the fourth aspect of the present invention, the gradation correction section reads out the image data which is stored in the image data storage section, based on the second refreshing signal in the coercively provided drive period. In this way, in the coercively provided drive period, it is possible to make application voltages in the pixel formation portion smaller than the application voltages in the immediately preceding drive period.

According to the fifth aspect of the present invention, it is possible to determine if an image has been updated, by comparing on frameful of image data between the current frame and the previous frame.

According to the sixth aspect of the present invention, a sum of gradation values of externally received one frameful of image data is stored in the image information storage section, as information of the image. The sum of gradation values of externally received one frameful of image data has a relatively small data size. Therefore, it is possible to use the image information storage section of a relatively small memory size.

According to the seventh aspect of the present invention, a histogram of gradation values of externally received one frameful of image data is stored in the image information storage section, as information of the image. Therefore, it is possible to increase accuracy of the image update identification performed by the coercive refreshing determination section, over the sixth aspect of the present invention.

According to the eighth aspect of the present invention, externally received one frameful of image data is stored in the image information storage section, as information of the image. Therefore, it is possible to increase accuracy of the image update identification performed by the coercive refreshing determination section, with more accurate calculation than in the seventh aspect of the present invention.

According to the ninth aspect of the present invention, it is possible to provide the drive period at a predetermined timing based on the externally received synchronizing signal.

According to the tenth aspect of the present invention, it is possible to reduce power consumption since writing of one frameful of image data takes place only at an image update.

According to the eleventh aspect of the present invention, it is possible to provide the drive period at a predetermined timing without receiving a synchronizing signal externally, by generating a clock signal internally.

According to the twelfth aspect of the present invention, external image data is supplied directly to the gradation correction section at the time of the coercively provided drive period, which makes it possible to perform data voltage writing immediately based on corrected image data corrected by the gradation correction section upon image update.

According to the thirteenth aspect of the present invention, it is possible to provide the drive period coercively only for the updated region in the screen while the intermission period is continued for the other regions in the screen. Like the first aspect of the present invention, pixels included in the updated region but not having their gradation values changed by the image update have their respective pixel formation portions supplied, through writing, with data voltages that have the same polarity as data voltages written in the immediately preceding drive period but have values closer to the common voltage in the coercively provided drive period, than do the data voltages written in the immediately preceding drive period. The arrangement reduces increase in application voltage in the coercively provided drive period for the pixels which are included in the updated region but not having their gradation values changed by the image update; therefore, the arrangement also reduces increase in the effective value of the application voltage in the pixel formation portion. Since brightness change is therefore prevented from occurring in the updated region at the time of image update, it is possible to suppress brightness difference between the updated region and the other regions.

According to the fourteenth aspect of the present invention, the same advantages are provided as offered by the third aspect of the present invention in the arrangement that, the drive period is provided coercively only for updated regions in the screen while the intermission period is continued for the other regions in the screen, at the time of image update.

According to the fifteenth aspect of the present invention, the same advantages are provided as offered by the fourth aspect of the present invention in the arrangement that, the drive period is provided coercively only for updated regions in the screen while the intermission period is continued for the other regions in the screen, at the time of image update.

According to the sixteenth aspect of the present invention, the same advantages are provided as offered by the first aspect of the present invention, in a driving method of the display device.

DESCRIPTION OF EMBODIMENTS

Hereinafter, a first through a third embodiments of the present invention will be described with reference to the attached drawings. Hereinafter, a constituent element which is designed to output an active signal may output a non-active signal or stop signal output when the constituent element is not outputting an active signal. Hereinafter, the direction in which the data lines extend will be called column direction, whereas the direction in which the scanning lines extend will be called row direction. Also, an array of constituent elements along the column direction may sometimes be called "column", whereas an array of constituent elements along the row direction may be called "row".

1. First Embodiment

1.1 Overall Configuration

Figure 1:
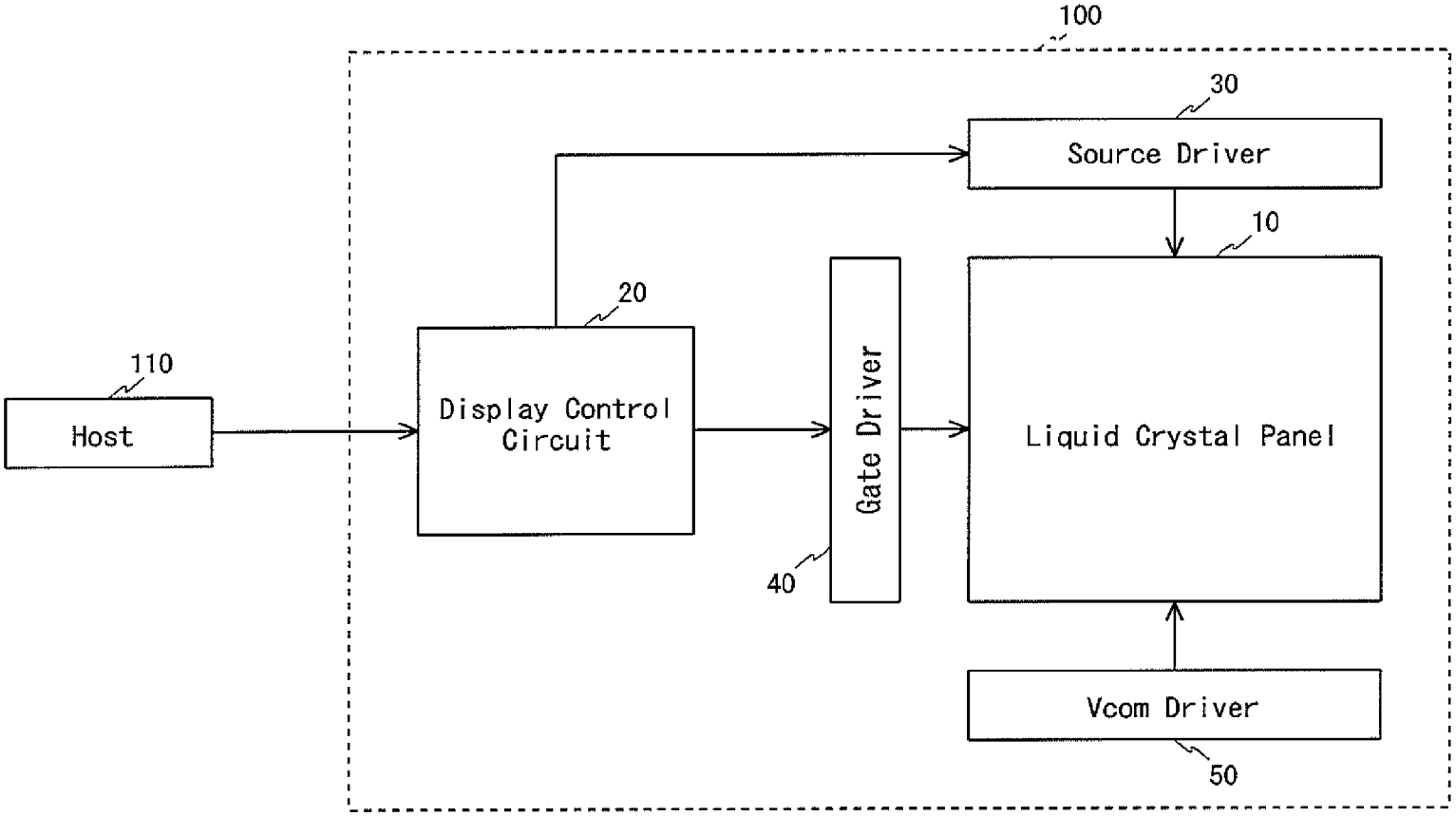
FIG. 1 is a block diagram for describing a configuration of a liquid crystal display device according to a first embodiment of the present invention.

FIG. 1 is a block diagram for describing a configuration of a liquid crystal display device 100 according to a first embodiment of the present invention. The liquid crystal display device 100 includes a liquid crystal panel 10, a display control circuit 20, a source driver 30, a gate driver 40, and a Vcom driver 50. The display control circuit 20 represents the display controller. The source driver 30 represents the data line drive circuit. The gate driver 40 represents the scanning line drive circuit. The Vcom driver 50 represents the common electrode drive circuit. In the present embodiment, the source driver 30, the gate driver 40 and the Vcom driver 50 constitute the driving section. One or both of the source driver 30 and the gate driver 40 may be formed integrally with the liquid crystal panel 10. Outside the liquid crystal display device 100, there is a host 110 which is constituted primarily by a central Processing unit (CPU).

The liquid crystal panel 10 is formed with a plurality of data lines, a plurality of gate lines, and a plurality of pixel formation portions each corresponding to one of intersections made by the data lines and the gate lines. The pixel formation portions are disposed in a matrix pattern. Each pixel formation portion is connected to one of the data lines and one of the gate lines which pass through a corresponding one of the intersections. The liquid crystal panel 10 is also formed with a common electrode arranged commonly to the plurality of pixel formation portions. In the present embodiment, the liquid crystal panel 10 is provided by one which employs a normally-black method.

The display control circuit 20 receives image data and a synchronization signal from the external host 110. In the present DESCRIPTION, it is assumed that the image data represents an image expressed in 8-bit gradation (using 256 gradation levels). Based on the image data and the synchronization signal received, the display control circuit 20 generates and outputs various signals for controlling the source driver 30 and the gate driver 40. The display control circuit 20 also outputs the image data to the source driver 30 at times of counter refreshing and coercive refreshing. The display control circuit 20 may also generate and output various signals for controlling the Vcom driver 50. The display control circuit 20 controls the source driver 30 and the gate driver 40 to implement an intermission driving based on AC driving by alternately repeating a drive period for refreshing the screen of liquid crystal panel 10 by writing data voltages based on the image data from the host 110 to the pixel formation portions, and an intermission period for stopping data voltage writing to the pixel formation portions. While the display control circuit 20 provides the drive period at a predetermined timing, it also provides the drive period coercively when the image, which is represented by the image data from the host 110, is updated during the intermission period; in this case, the intermission period is aborted. In other words, the display control circuit 20 performs counter refreshing and coercive refreshing. The display control circuit 20 according to the present embodiment sets the drive period and the intermission period universally across the screen. The display control circuit 20 makes the source driver 30 and the gate driver 40 respectively drive the data lines and the scanning lines in the drive period, while making the source driver 30 and the gate driver 40 respectively stop driving of the data lines and scanning lines in the intermission period.

The source driver 30 generates data voltages based on various signals and the image data from the display control circuit 20, and supplies these data voltages to the data lines, in the drive period. The gate driver 40 selects the scanning lines sequentially based on various signals from the display control circuit 20, in the drive period. The Vcom driver 50 gives the common electrode a common voltage. The data voltage is written to one of the pixel formation portions connected to a selected one of the scanning lines. In this way, a data voltage is written into each pixel formation portion, whereby screen refreshing is performed. In the intermission period, data voltage writing is not performed, so screen refreshing does not take place.

In the present embodiment, the source driver 30 performs dot-inversion driving, i.e. a type of the AC driving, based on control by the display control circuit 20. Under this, the source driver 30 controls data voltage polarity as follows: Specifically, the source driver 30 inverts data voltage polarity for each data line, and also inverts polarity for each scanning line selection period (1 horizontal period) in which one scanning line is selected. In other words, data voltage polarity is inverted for every column and every row. This creates a pattern that a pixel formation portion in which a positive-polarity data voltage is written is surrounded by pixel formation portions in which negative-polarity data voltages are written, and a pixel formation portion in which a negative-polarity data voltage is written is surrounded by pixel formation portions in which positive-polarity data voltages are written. The source driver 30 also inverts polarity of data voltage to be written to each pixel formation portion, for every counter refreshing. With details to be described later, at the time of coercive refreshing, the source driver 30 makes polarity of the data voltage to be written for each pixel formation portion identical with the polarity of data voltage which was written to the pixel formation portion in the immediately preceding counter refreshing.

It should be noted however, that there may be an arrangement where the source driver 30 performs line-inversion driving of inverting data voltage polarity for each predetermined number of rows, or column-inversion driving of inverting data voltage polarity for each predetermined number of columns. In whichever of the line-inversion driving and the column-inversion driving, the source driver 30 inverts the polarity of data voltage to be written to each pixel formation portion, like in the dot-inversion driving, i.e., for every counter refreshing. Also, as another arrangement, the source driver 30 may perform frame-inversion driving in which all pixel formation portions are given data voltages of the same polarity, and the polarity of data voltage to be written to pixel formation portion is inverted for every counter refreshing.

1.2 Pixel Formation Portion

Figure 2:
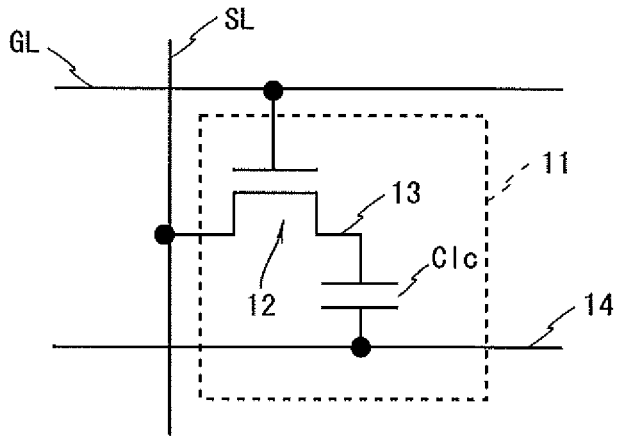
FIG. 2 is an equivalent circuit diagram of a pixel formation portion included in a liquid crystal panel shown in FIG. 1.

FIG. 2 is an equivalent circuit diagram of a pixel formation portion 11 which is included in the liquid crystal panel shown in FIG. 1. The pixel formation portion 11 includes: a TFT 12 which has its gate terminal as a control terminal connected to a scanning line GL that passes through the corresponding intersection, and has its source terminal as a first conduction terminal connected to a data line SL that passes through said corresponding intersection; a pixel electrode 13 which is connected to a drain terminal, serving as a second conduction terminal, of the TFT 12; a common electrode 14 which is provided commonly to a plurality of the pixel formation portions 11; and a liquid crystal layer which is sandwiched between the pixel electrode 13 and the common electrode 14 and is common to the pixel formation portions 11. The pixel electrode 13 and the common electrode 14 form a liquid crystal capacitance Clc, which constitutes a pixel capacitance. Often, there is provided an auxiliary capacitance in parallel with the liquid crystal capacitance Clc in order to ensure a voltage held in the pixel capacitance; however, for the sake of descriptive convenience, the present DESCRIPTION assumes that the pixel capacitance consists only of the liquid crystal capacitance Clc. When the TFT 12 is in its ON state, a data voltage is written from the data line SL to the liquid crystal capacitance Clc. The other terminal of the liquid crystal capacitance Clc, i.e., the common electrode 14, is supplied with a common voltage from the Vcom driver 50. In this way, the liquid crystal capacitance Clc holds a liquid crystal application voltage, which is determined by the data voltage and the common voltage, or more specifically, is given by a difference, right after refreshing, between the data voltage and the common voltage. Note, however, that after the refreshing, liquid crystal dielectric constant changes as the liquid crystal responds to the input, and therefore the liquid crystal application voltage becomes smaller than the difference between the data voltage and the common voltage.

There is no specific limitation to the method of alignment in the liquid crystal layer of the liquid crystal panel 10. Examples of usable method include Vertical Alignment (VA) method, Twisted Nematic (TN) method, Multi-domain Vertical Alignment (MVA) method and In-Plane Switching (IPS) method.

As described above, the source driver 30 performs dot-inversion driving in the present embodiment, and therefore the common voltage which the Vcom driver 50 gives to the common electrode 14 has a fixed value. For this reason, the present DESCRIPTION will sometimes treat "holding a data voltage" to be identical with "holding a liquid crystal application voltage". There may be arrangements in actual application, that the Vcom driver 50 changes the common voltage value according to e.g. refreshing rate, but these will not be covered here. In cases where the source driver 30 performs line-inversion driving, there may be an arrangement that the Vcom driver 50 shifts the common voltage for every horizontal period; or in cases where the source driver 30 performs frame-inversion driving, there may be an arrangement that the Vcom driver 50 shifts the common voltage for every counter refreshing. These enables to obtain a liquid crystal application voltage of sufficient magnitude while keeping a data voltage amplitude small enough, making it possible to reduce power consumption by the source driver 30.

The TFT 12 functions as a switching element which assumes an ON state to allow writing of a data voltage to the liquid crystal capacitance Clc, and an OFF state to keep holding the written data voltage (in other words, an electric potential of the pixel electrode 13). The TFT 12 may be provided, for example, by an oxide TFT which has its channel layer formed of an oxide semiconductor. Particularly suitable among many oxide TFTs is a TFT whose channel layer is formed of InGaZnOx oxide, i.e., an oxide semiconductor containing indium (In), gallium (Ga), zinc (Zn), and oxygen (O) as primary ingredients (hereinafter called "IGZO-TFT"). IGZO-TFTs feature a significantly smaller off-leak current than silicon TFTs which use, e.g., amorphous silicon to form the channel layer. Therefore, IGZO-TFTs can hold a data voltage for a long time once it is written to the liquid crystal capacitance Clc. Examples of other oxide semiconductors than InGaZnOx which will provide a comparable advantage if their channel layers are formed of an oxide semiconductor including at least one of indium, gallium, zinc, copper (Cu), silicon (Si), tin (Sn), aluminum (Al), calcium (Ca), germanium (Ge), and lead (Pb).

1.3 Display Control Circuit

Figure 3:
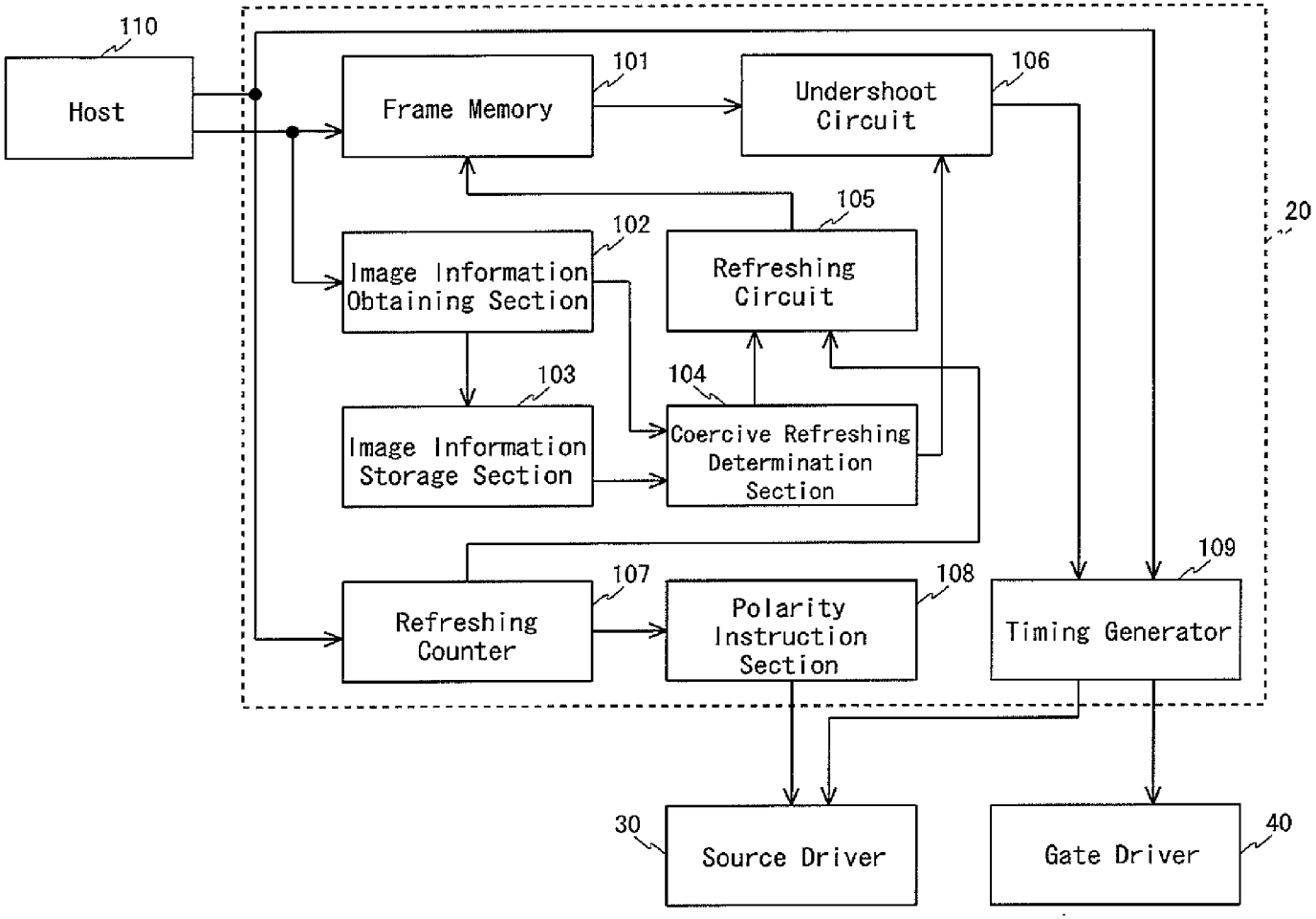
FIG. 3 is a block diagram for describing a configuration of a display control circuit shown in FIG. 1.

FIG. 3 is a block diagram for describing a configuration of the display control circuit 20 in FIG. 1. The display control circuit 20 includes a frame memory 101, an image information obtaining section 102, an image information storage section 103, a coercive refreshing determination section 104, the refreshing circuit 105, an undershoot circuit 106, a refreshing counter 107, a polarity instruction section 108, and a timing generator 109. The frame memory 101 represents the image data storage section. The coercive refreshing determination section 104 represents the second refreshing controller. The refreshing circuit 105 represents the refreshing section. The undershoot circuit 106 represents the gradation correction section. The refreshing counter 107 represents the first refreshing controller.

The frame memory 101 receives one frameful of image data (hereinafter, may also simply called "image data" from the host 110, and stores this one frameful of image data. It should be noted here that frames in the image data are identified, for example, on the basis of a synchronization signal outputted from the host 110; no detailed description therefor will be made here. The frame memory 101 receives an active output control signal to be described later from the refreshing circuit 105, whereupon it outputs the stored one frameful of image data to the undershoot circuit 106.

The image information obtaining section 102 receives one frameful of image data from the host 110, like the frame memory 101. The image information obtaining section 102 obtains information of an image (hereinafter called "image information") indicated by the one frameful of image data received, and then outputs the image information to the image information storage section 103 and the coercive refreshing determination section 104. Specifically, the image information obtaining section 102 according to the present embodiment obtains a sum of gradation values of the received one frameful of image, and provides the sum as the image information. In other words, the image information obtaining section 102 obtains a check sum value of the gradation values in the one frameful of image data, and uses this check sum value as the image information. The check sum value has a relatively small data size.

The image information storage section 103 receives the image information from the image information obtaining section 102, and stores the image information. The image information storage section 103 outputs the stored image information to the coercive refreshing determination section 104 in the next frame. Storage of image information received from the image information obtaining section 102 takes place after older image information, which is already in storage, has been outputted to the coercive refreshing determination section 104.

The coercive refreshing determination section 104 receives current-frame image information and previous-frame image information respectively from the image information obtaining section 102 and the image information storage section 103, and compares the two pieces of image information. If the current-frame image information is different from the previous-frame image information, the coercive refreshing determination section 104 determines that the image represented by the image data has been updated, and then outputs an active coercive refreshing signal to the refreshing circuit 105 and outputs an active correction instruction signal to the undershoot circuit 106. It should be noted here that the coercive refreshing determination section 104 may be designed to determine that the image represented by the image data is not updated if the current-frame image information differs only slightly from the previous-frame image information. The coercive refreshing signal represents the second refreshing signal. In the present embodiment, timing for performing a coercive refreshing can be specified by the image information obtaining section 102, the image information storage section 103 and the coercive refreshing determination section 104.

The refreshing circuit 105 receives the active coercive refreshing signal from the coercive refreshing determination section 104, and an active counter refreshing signal to be described later from the refreshing counter 107, and upon reception of whichever of these, outputs an active output control signal to the frame memory 101. It should be noted here that when an image is updated, then data stored in the frame memory 101 is updated. However, if the image data stored in the frame memory 101 is outputted to the undershoot circuit 106 right after the coercive refreshing determination section 104 determines that the image is updated, then there can be a cases where old image data which represents an image before the update will be outputted to the undershoot circuit 106. For this reason, it is desirable that a certain amount of time, e.g., one frame period, is provided between the time when the refreshing circuit 105 receives an active coercive refreshing signal to the time when it outputs the active output control signal to the frame memory 101. Alternatively, there may be an arrangement that the output of the active coercive refreshing signal from the coercive refreshing determination section 104 is delayed by one frame period.

The undershoot circuit 106 receives the image data stored in the frame memory 101. If an active correction instruction signal is received from the coercive refreshing determination section 104, then the undershoot circuit 106 makes correction by performing a subtraction operation to the image data received from the frame memory 101, and outputs the corrected image data to the timing generator 109. Specifically, the undershoot circuit 106 decreases gradation values of image data received from the frame memory 101. The unit used in changing the gradation value (hereinafter called "gradation unit") is one gradation. For example, decreasing the gradation value by one gradation from a 128-gradation image data will give a 127-gradation image data as a result of the correction, and decreasing the gradation value by two gradations will yield a 126-gradation image data as the corrected data.

Here, attention will be paid to the unchanged pixel: in coercive refreshing, the image data has a smaller gradation value than the gradation value of the image data used in the immediately preceding counter refreshing. Thus, for an unchanged pixel, the data voltage to be written to the liquid crystal capacitance Clc at the time of coercive refreshing has a value closer to the common voltage than does the data voltage written to the liquid crystal capacitance Clc at the time of immediately preceding counter refreshing. If the common voltage is expressed as 0V, a positive-polarity data voltage is expressed as a positive voltage, and a negative-polarity data voltage as a negative voltage, then "the data voltage has a value closer to the common voltage" means that the data voltage has a decreased absolute value. Since the liquid crystal panel 10 employs a normally-black method as described earlier, a smaller gradation value as a result of the correction performed by the undershoot circuit 106 means that the data voltage to be written to the liquid crystal capacitance Clc at the time of coercive refreshing has a smaller absolute value than the original value. In other words, the data voltage is undershot.

The undershoot circuit 106 should decrease the gradation value only for the unchanged pixels among the pixels of the updated image; there is no need for decreasing the gradation value for the changed pixels. However, decreasing the gradation value for all of the pixels of an updated image provides an advantage that it is no longer necessary to differentiate the unchanged pixels from the changed pixels, which simplifies the process performed in the undershoot circuit 106. For this reason, the undershoot circuit 106 in the present embodiment decreases the gradation value of the image data from the frame memory 101 for all the pixels if an active correction instruction signal is received from the coercive refreshing determination section 104. The present invention is not limited to this, however: The undershoot circuit 106 may differentiate unchanged pixels from changed pixels, and decrease gradation values only for the unchanged pixels. When the undershoot circuit 106 decreases the gradation value of image data received from the frame memory 101 for all pixels, it is not necessary that the amount of change in the gradation value is the same in all of the pixels. Even so, if the undershoot circuit 106 decreases the gradation value of image data received from the frame memory 101 for all pixels, by the same amount of change in the gradation value in all of the pixels, the process to be performed in the undershoot circuit 106 becomes even more simplified.

The refreshing counter 107 receives the synchronization signal from the host 110, and based on the synchronization signal, increments, for each frame, a count value used for determining the timing to perform counter refreshing. When the count value reaches a predetermined value, the refreshing counter 107 outputs an active counter-refreshing signal to the refreshing circuit 105, and outputs an active polarity-inversion signal for inverting data voltage polarity to the polarity instruction section 108. The counter refreshing signal represents the first refreshing signal. The refreshing counter 107 resets the count value once the count value reaches the predetermined value. The arrangement for handling the count value described above is only an example, so other arrangements may be utilized as well.

The polarity instruction section 108 outputs a polarity signal which indicates data voltage polarity, to the source driver 30. Upon reception of an active polarity inversion signal from the refreshing counter 107, the polarity instruction section 108 inverts a polarity indicated by the polarity signal. This causes data voltage polarity inversion per counter refreshing. At the time of coercive refreshing, however, the polarity instruction section 108 does not receive an active polarity inversion signal, so data voltage polarity is not inverted.

The timing generator 109 receives the synchronization signal from the host 110 both in the drive period and in the intermission period, and receives image data from the undershoot circuit 106 in the drive period. The image data which the timing generator 109 receives at the time of coercive refreshing is corrected image data corrected by the undershoot circuit 106. At the time of counter refreshing, the undershoot circuit 106 does not receive an active correction instruction signal, so it does not make correction to the image data received from the frame memory 101, and outputs the received image data to the timing generator 109 without making any correction. The timing generator 109 generates source control signals such as a source start pulse signal and a source clock signal based on the synchronization signal received and outputs these signals to the source driver 30 while it also generates gate control signals such as a gate start pulse signal and a gate clock signal and output them to the gate driver 40. Upon reception of image data, the timing generator 109 adjusts an output timing based on the synchronization signal, and outputs the image data to the source driver 30.

If the timing generator 109 does not receive image data, it makes the source driver 30 and the gate driver 40 stop driving the data lines and scanning lines respectively. For example, the timing generator 109 may stop outputting of the gate control signal and the source control signal when it does not receive image data. This enables to cause the source driver 30 and the gate driver 40 to stop driving the data lines and the scanning lines respectively. As an alternative arrangement, the timing generator 109 outputs, when it receives image data, an active enable signal to the source driver 30 and the gate driver 40 to allow the source driver 30 and the gate driver 40 to drive the data lines and the scanning lines respectively, whereas the timing generator 109 does not output such an active enable signal when it does not receive image data thereby causing the source driver 30 and the gate driver 40 to stop driving of the data lines and the scanning lines. It should be noted here that the active enable signal may be outputted by the refreshing counter 107, for example, to the source driver 30 and the gate driver 40, rather than by the timing generator 109.

1.4 Intermission Driving

Figure 4:
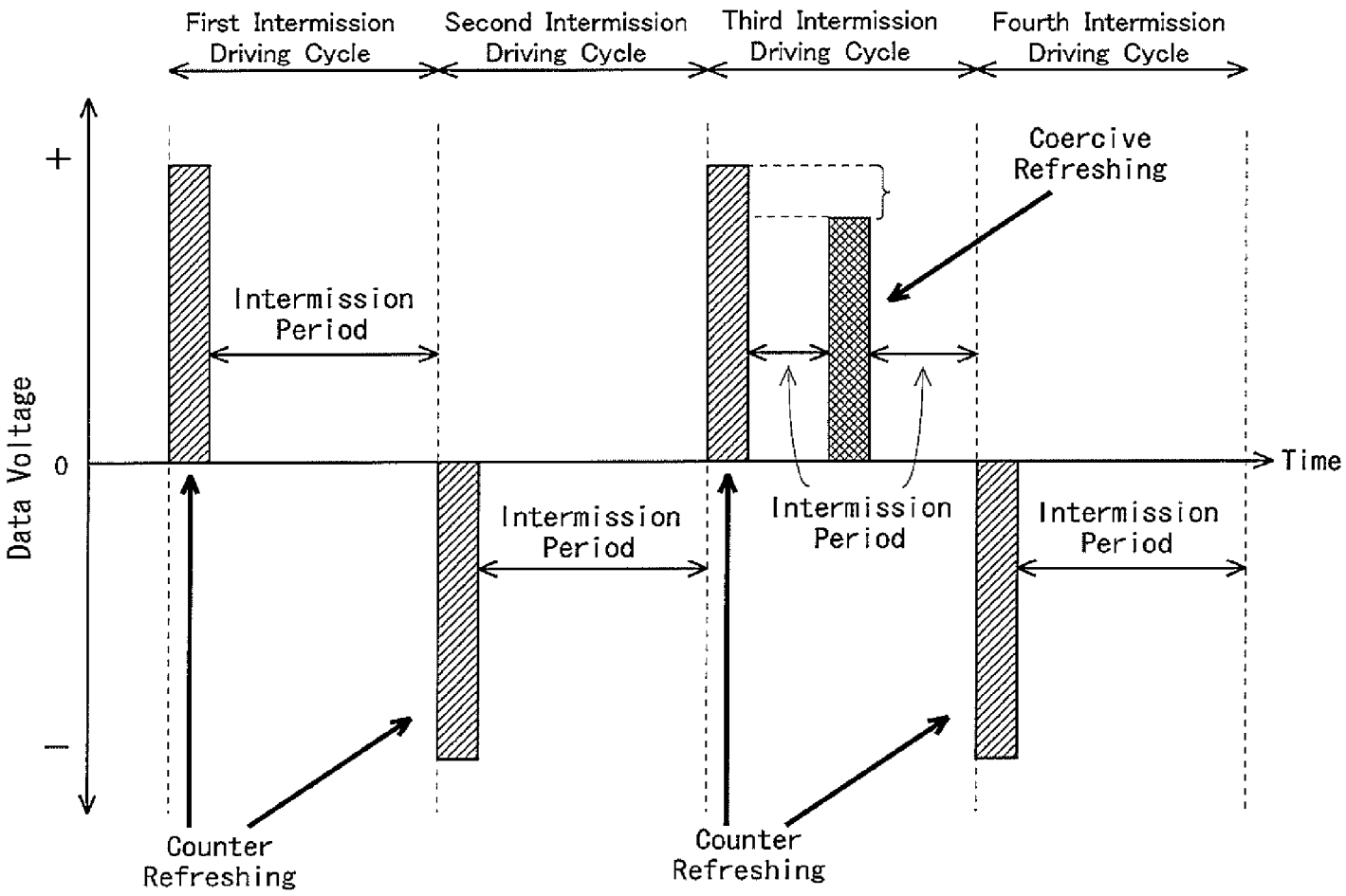
FIG. 4 is a diagram for describing an intermission driving according to the first embodiment.

FIG. 4 is a diagram for describing an intermission driving according to the present embodiment. Since FIG. 4 is identical with FIG. 15 except for a data voltage at the time of coercive refreshing, description common to both will be appropriately omitted. A focus pixel here is an unchanged pixel. In respective counter refreshings during the first through the fourth intermission driving cycles, data voltages which are applied to the liquid crystal capacitance Clc respectively have positive polarity, negative polarity, positive polarity, and negative polarity. Therefore, in the respective counter refreshings during the first through the fourth intermission driving cycle, liquid crystal application voltages which are applied to the liquid crystal layer respectively have positive polarity, negative polarity, positive polarity, and negative polarity. The liquid crystal application voltage changes with time during the intermission period if the image is not updated, and counter refreshing periodically brings the liquid crystal application voltage back to the original value. This keeps the image displayed in the screen.

In the third intermission driving cycle, a coercive refreshing is performed during the intermission period, in the same fashion as the counter refreshing during the third intermission driving cycle, i.e., a positive-polarity data voltage is used for the writing. In the present embodiment, the undershoot circuit 106 corrects the gradation value of the image data at the time of coercive refreshing and therefore, the data voltage to be written to the liquid crystal capacitance Clc has a value closer to the common voltage than does the data voltage written to the liquid crystal capacitance Clc at the time of counter refreshing in the third intermission driving cycle. So, in the coercive refreshing during the third intermission driving cycle, a liquid crystal application voltage which has a smaller magnitude than the one in the counter refreshing during the third intermission driving cycle is applied to the liquid crystal layer. As described, in the present embodiment, the data voltage to be written to the liquid crystal capacitance Clc at the time of coercive refreshing in the third intermission driving cycle, has the same polarity as the data voltage written at the time of counter refreshing in the third intermission driving cycle, but has a value closer to the common voltage than said data voltage, unlike the intermission driving shown in FIG. 15.

Figure 5:
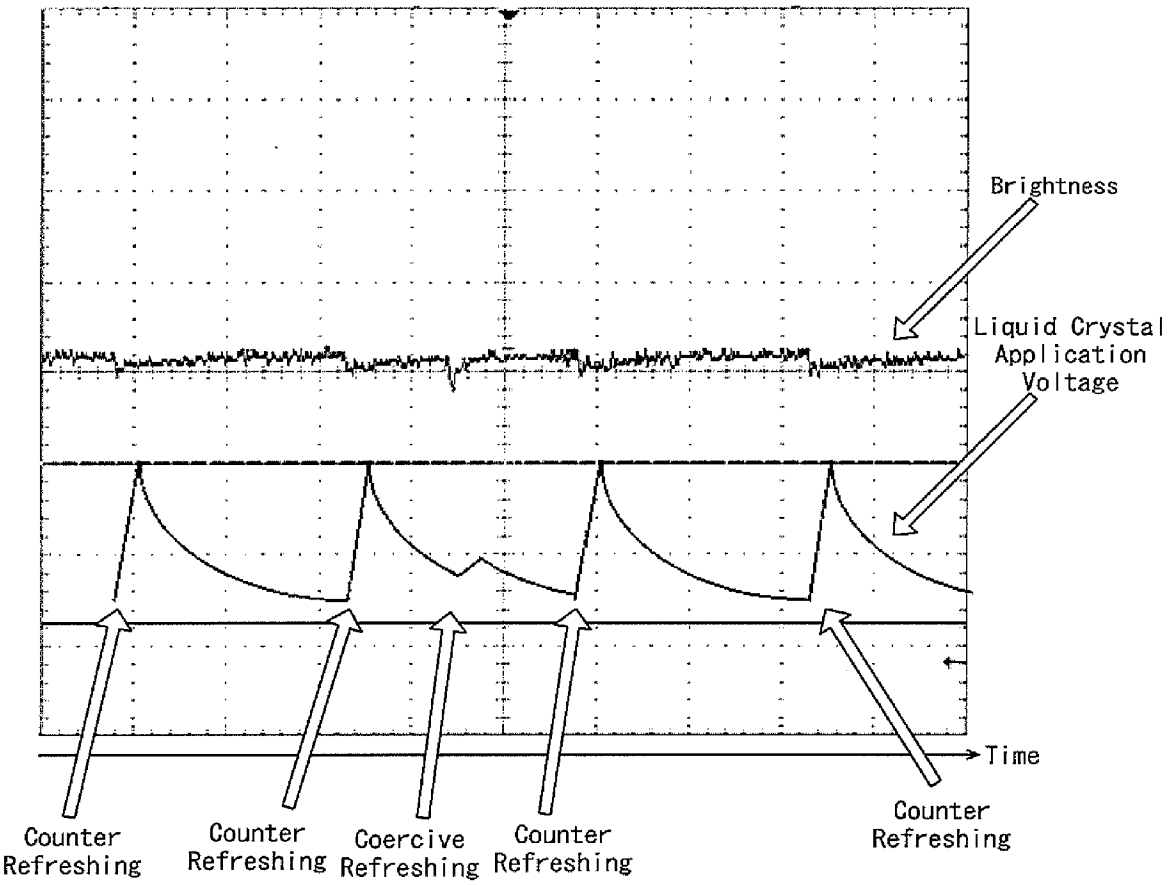
FIG. 5 shows how a liquid crystal application voltage and a brightness change in the intermission driving according to the first embodiment.

FIG. 5 shows how the liquid crystal application voltage (absolute value) and brightness change in the intermission driving shown in FIG. 4. Note that in FIG. 5, a period from the second counter refreshing from the left to the third counter refreshing from the left corresponds to the third intermission driving cycle in FIG. 4. As shown in FIG. 5, the liquid crystal application voltage increases when a data voltage is written to the liquid crystal capacitance Clc at the time of refreshing, and then decreases as time passes. In cases where there is an image update (note, however, that the focus pixel is an unchanged pixel as has been described earlier), the liquid crystal application voltage increases as a data voltage is written in the counter refreshing; then the liquid crystal application voltage begins decreasing as time passes; but on its way down, a coercive refreshing takes place. The present embodiment differs from the example shown in FIG. 15 and FIG. 16; i.e., at the time of coercive refreshing, a data voltage which has the same polarity as the data voltage written in the immediately preceding counter refreshing but has a value closer to the common voltage than does that data voltage is written to the liquid crystal capacitance Clc. This reduces increase in the liquid crystal application voltage at the time of coercive refreshing, and therefore reduces increase in the effective value of the liquid crystal application voltage. Consequently, as shown in FIG. 5, it is possible to suppress brightness change which can occur at the time of image update.

Although FIG. 5 shows a slight difference between the liquid crystal application voltage at the time of the coercive refreshing and the voltage immediately before that. It is desirable to design the image data gradation value correction so that these two liquid crystal application voltages will be identical with each other by taking into account how the liquid crystal application voltage will change after the counter refreshing. In other words, it is desirable that the amount of correction to be made to the gradation value in the undershoot circuit 106 should be the amount which makes the liquid crystal application voltage at the time of the coercive refreshing identical with the liquid crystal application voltage immediately before that. However, it is impossible, for example, to change 128 gradations to 126.5 gradations by subtracting 1.5 gradations, because the gradation unit is one as described earlier, even if such a correction would make the coercive refreshing liquid crystal application voltage identical with the immediately preceding liquid crystal application voltage. Correction to such a level of precision is impossible. Specifically, 128 gradations should be decreased by 1 gradation, to obtain 127 gradations, or the gradation value should be decreased by 2 gradations to obtain 126 gradations. Making the liquid crystal application voltages at the time of coercive refreshing exactly match the liquid crystal application voltages at the time immediately before that is difficult.

As a solution, it is possible, for example, that the undershoot circuit 106 converts 8-bit gradation image data (i.e., image data having 256 gradation levels) into 10-bit gradation image data (image data having 1024 gradation levels), so that image data correction can be made using a gradation unit which is practically ¼ of the original size. Hereinafter, X-bit gradation image data (image data having $2^x$ gradation levels) will be called "X-bit gradation image data". Specific procedures are as follows: Converting 8-bit gradation image data into 10-bit gradation image data means, for example, that 128 gradations in the 8-bit gradation expression is converted into 512 gradations in the 10-bit gradation expression. While the gradation unit is still one, 1 gradation in the 10-bit gradation expression is equal to 0.25 gradations in the 8-bit gradation expression, and therefore conversion from 8-bit gradation image data to 10-bit gradation image data makes the gradation unit ¼ in effect. For example, if 512 gradations in the 10-bit gradation expression is decreased by 6 gradations, to 506 gradations, the result in effect is 126.5 gradations in the 8-bit gradation expression. It is then necessary that 10-bit gradation image data after correction must be re-converted to 8-bit gradation image data, but a simple re-conversion will not reflect the result of the correction performed by using the gradation unit of ¼ in essence, on the 8-bit gradation image data. As a solution, it is desirable that a conventional frame rate control (FRC) process or a conventional dithering process, for example, is performed together with the process of re-converting the corrected 10-bit gradation image data to 8-bit gradation image data. In this way, it becomes possible to reflect the result of the correction made on the 8-bit gradation image data by using the gradation unit of ¼ the size in essence. The FRC or the dithering is performed by the undershoot circuit 106 and the timing generator 109.

1.5 Advantages

According to the present embodiment, intermission driving based on AC driving is performed and the drive period and the intermission period are provided universally across the screen in the liquid crystal display device 100. Under this configuration, if a pixel formation portion provides an unchanged pixel at the time of coercive refreshing, a data voltage which is written to the liquid crystal capacitance Clc has the same polarity as of the data voltage written in the immediately preceding counter refreshing, and a value which is closer to the common voltage than does that data voltage. This reduces increase in the liquid crystal application voltage at the time of coercive refreshing, and therefore reduces increase in the effective value of the liquid crystal application voltage. Therefore it is possible to suppress potential brightness change at the time of image update.

Also, According to the present embodiment, it is possible to ensure polarity balance because data voltage polarity is inverted for every counter refreshing based on an active polarity inversion signal.

It is also possible according to the present embodiment, to determine if an image update is made or not, by comparing image information in the current frame and in the previous frame using the image information obtaining section 102, the image information storage section 103 and the coercive refreshing determination section 104.

According to the present embodiment, a check sum value of gradation values of one frameful of image data is stored in the image information storage section 103 as image information. Since the check sum value has a relatively small data size, the arrangement allows the image information storage section 103 to be of a relatively small memory size.

Also, according to the present embodiment the TFT 12 is provided by an IGZO-TFT. Since IGZO-TFTs feature a significantly small off-leak current, the liquid crystal application voltage does not change significantly. This makes it possible to extend the intermission period for decreased power consumption.

1.6 First Variation

Figure 6:
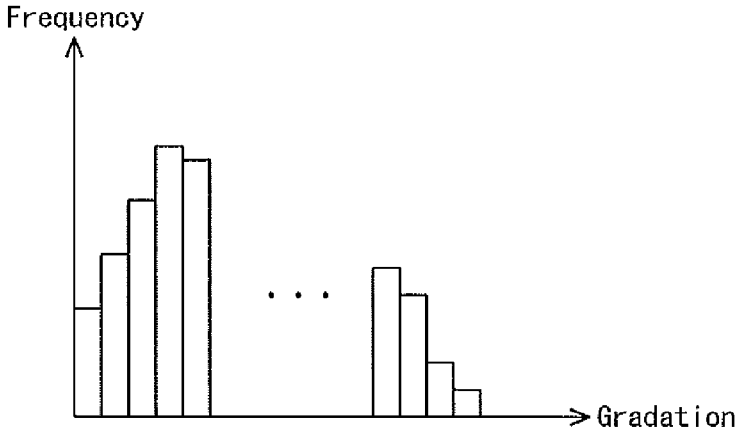
FIG. 6 shows an example of gradation histogram according to a first variation of the first embodiment.

In a first variation of the first embodiment, the image information obtaining section 102 obtains a gradation value histogram (hereinafter called "gradation histogram") of one frameful of image data received by the host 110, and uses this as the image information. FIG. 6 shows an example of the gradation histogram according to the present variation. The vertical axis and the horizontal axis represent frequency (number of times) and gradation respectively.

In the method used in the first embodiment, where a check sum value is used as the image information, there is a problem for example, that an image in which all pixels therein have an intermediate gradation is determined as the same as an image in which pixels in the left half of the image have a white gradation and pixels in the right half of the image have a black gradation. On the contrary, a method where a gradation histogram is used as the image information like in the present variation, determination is made on the basis of frequency at which each gradation value appears, and therefore, images such as those which will be misjudged by the method in which a check sum value is used as the image information as described above are judged correctly as being different from each other. In this way, according to the present variation, it is possible to increase image update identification accuracy by the coercive refreshing determination section 104 over the first embodiment.

1.7 Second Variation

In a second variation of the first embodiment, the image information obtaining section 102 obtains gradation values of one frameful of image data received from the host 110, and uses this as the image information. Specifically, the image information obtaining section 102 uses one frameful of image data received from the host 110, as the image information. Therefore, according to the present variation, the image information storage section 103 has the same configuration as the frame memory 101.

Although the first variation of the first embodiment can increase image update identification accuracy by the coercive refreshing determination section 104 over the first embodiment, two color images will be determined as the same if, for example, all pixels have the same gradation, even if the two images have different colors. Also, for example, an image in which pixels in the left half of the image have a white gradation and pixels in the right half of the image have a black gradation is misjudged as the same as an image in which pixels in the left half of the image have a black gradation and pixels in the right half of the image have a white gradation. On the contrary, according to the present variation, the image information is provided by one frameful of image data, so it is possible to compare color data for each pixel. Therefore, images such as those which will be misjudged by the method in which a gradation histogram is used as the image information as described above are judged correctly as being different from each other. In this way, according to the present variation, it is possible to increase image update identification accuracy by the coercive refreshing determination section 104 over the first variation of the first embodiment.

1.8 Third Variation

Figure 7:
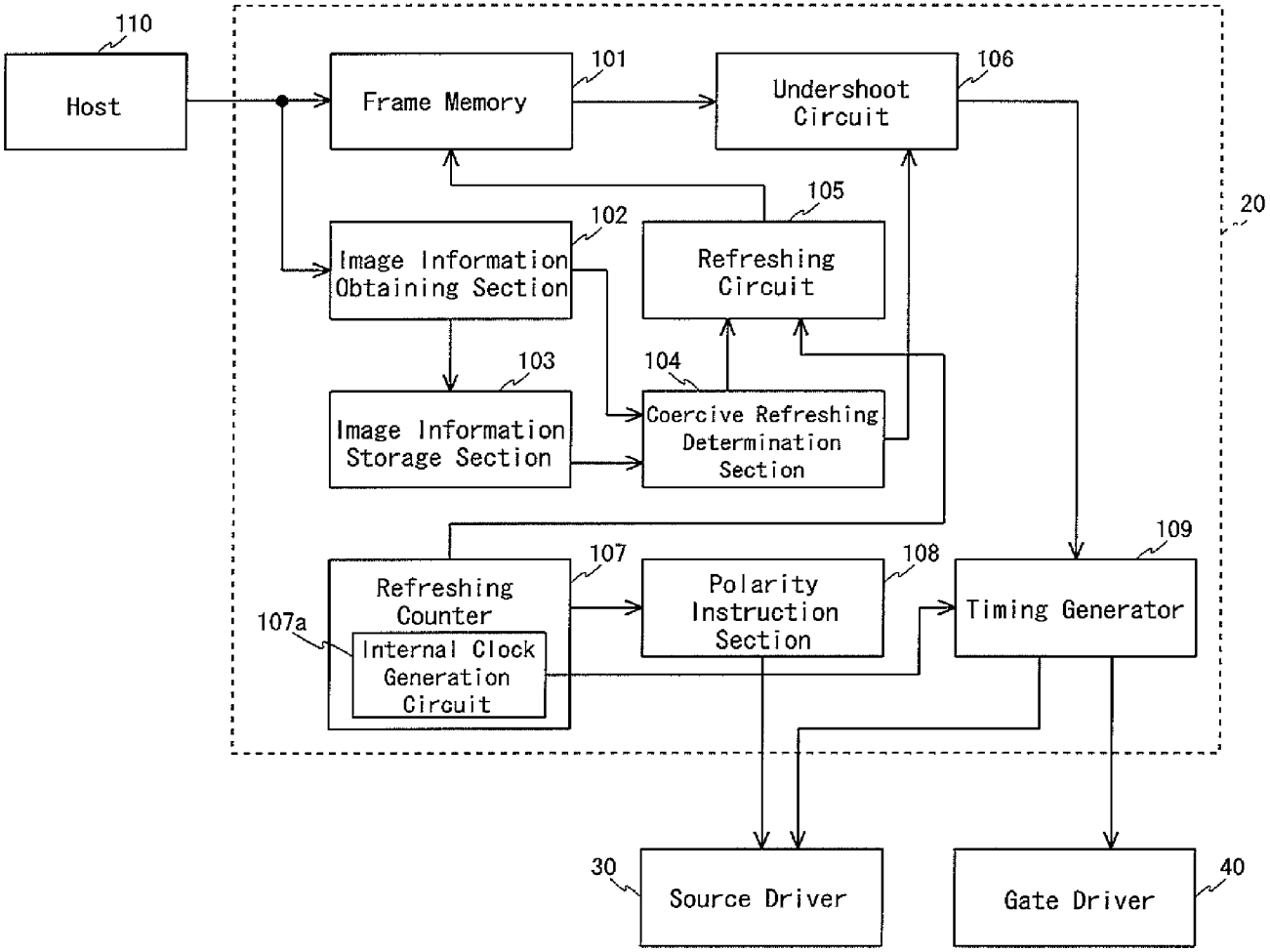
FIG. 7 is a block diagram for describing a configuration of a display control circuit according to a third variation of the first embodiment.

FIG. 7 is a block diagram for describing a configuration of a display control circuit 20 according to a third variation of the first embodiment. In the present variation, image data and a synchronization signal are outputted from the host 110 only at the time of image update. Due to this arrangement, the refreshing counter 107 in the present variation cannot increment the count value based on the synchronization signal, so it has an internal clock generation circuit 107*a* to generate an internal clock signal. The internal clock signal functions as an equivalent of the synchronization signal in the first embodiment.

Based on the internal clock signal, the refreshing counter 107 operates in the same way as it operates in the first embodiment based on synchronization signal. Also, the timing generator 109 in the present variation cannot operate as it does in the first embodiment based on the synchronization signal, so it receives the internal clock signal from the internal clock generation circuit 107*a*, and operates in the same way as in the first embodiment. The synchronization signal which is outputted from the host 110 only at the time of image update is utilized, as described earlier, to identify frames in the image data. This synchronization signal may be given to the refreshing counter 107 or to the timing generator 109. As described, according to the present variation, the host 110 outputs image data and a synchronization signal only at the time of image update, and writing of the image data to the frame memory 101 takes place. Therefore, it is possible to decrease power consumption.

1.9 Fourth Variation

Figure 8:
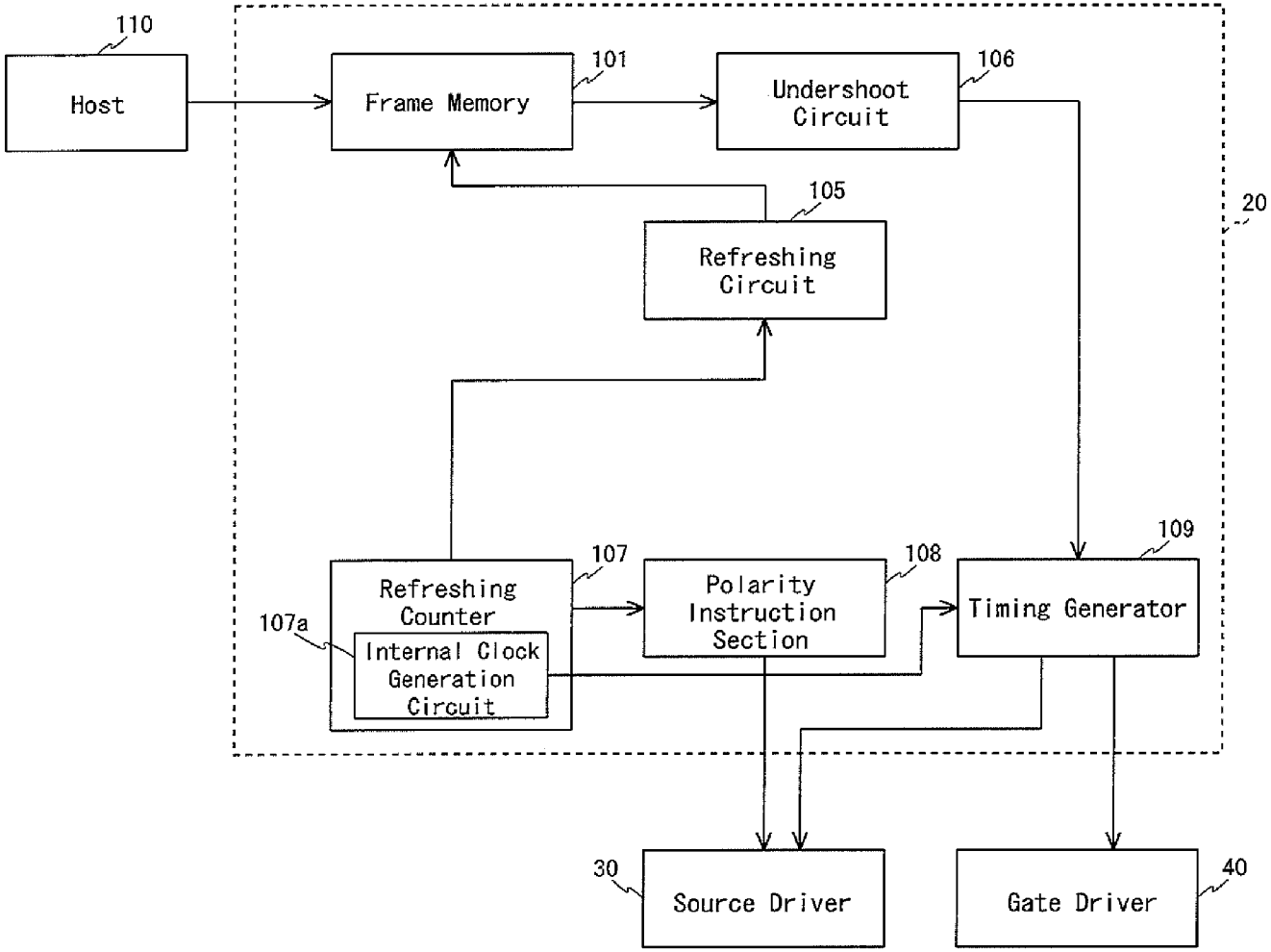
FIG. 8 is a block diagram for describing a configuration of a display control circuit according to a fourth variation of the first embodiment.

FIG. 8 is a block diagram for describing a configuration of a display control circuit 20 according to a fourth variation of the first embodiment. The display control circuit 20 in the present variation is the one according to the third variation of the first embodiment which does not include, however, the image information obtaining section 102, the image information storage section 103, and the coercive refreshing determination section 104. Since the host 110 outputs image data and a synchronization signal only at the time of image update as described above, it is possible to specify the coercive refreshing timing without the image information obtaining section 102, the image information storage section 103 and the coercive refreshing determination section 104. In this way, according to the present variation, it is possible to reduce the circuit size of the display control circuit 20 by eliminating the image information obtaining section 102, the image information storage section 103 and the coercive refreshing determination section 104.

1.10 Fifth Variation

Figure 9:
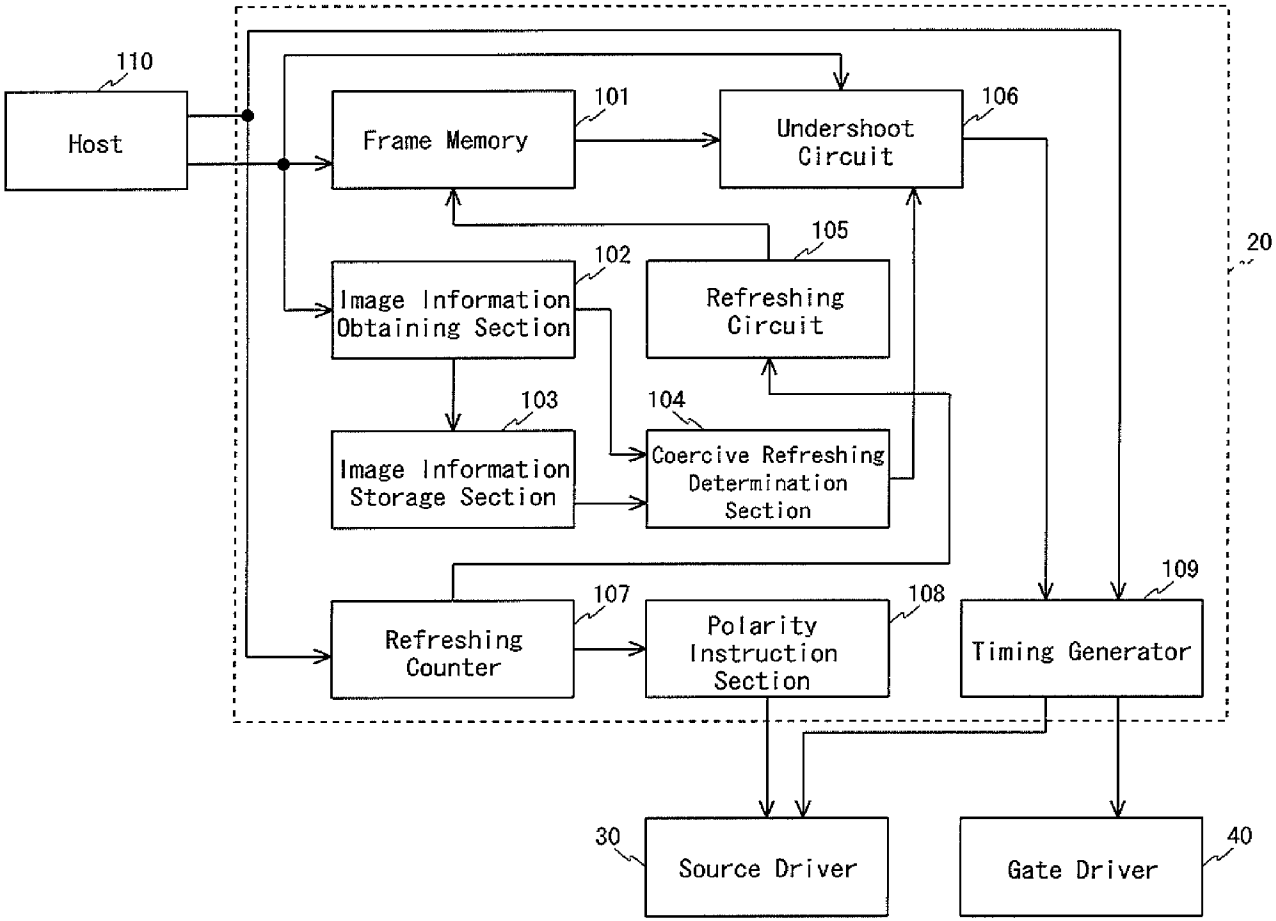
FIG. 9 is a block diagram for describing a configuration of a display control circuit according to a fifth variation of the first embodiment.

FIG. 9 is a block diagram for describing a configuration of a display control circuit 20 according to a fifth variation of the first embodiment. The display control circuit 20 in the present variation gives image data which is outputted from the host 110 according to the first embodiment, not only to the frame memory 101 and the image information obtaining section 102 but also to the undershoot circuit 106.

In the present variation, the coercive refreshing determination section 104 outputs an active correction instruction signal but does not output an active coercive refreshing signal upon determination that image data indicates that the image represented thereby is updated. Because of this arrangement, in the present variation, image data stored in the frame memory 101 is not outputted to the undershoot circuit 106 at the time of coercive refreshing. The undershoot circuit 106 receives imaged data from the host 110 and therefore, at the time of coercive refreshing, it corrects gradation values of the image data received from the host 10, and outputs the corrected image data to the timing generator 109. It should be noted here that the undershoot circuit 106 does not correct image data from the host 110 and output the corrected data, nor does it output image data as received from the host 110, unless it receives an active correction signal.

According to the first embodiment, the undershoot circuit 106 receives image data which is stored in the frame memory 101 at the time of coercive refreshing. Therefore, as described earlier, it is necessary that a certain amount of time, e.g., one frame period, is provided between the time when the refreshing circuit 105 receives an active coercive refreshing signal to the time when it outputs the active output control signal to the frame memory 101, or that the output of the active coercive refreshing signal from the coercive refreshing determination section 104 is delayed by about one frame period. On the contrary, according to the present variation, the undershoot circuit 106 receives image data which is outputted from the host 110, at the time of coercive refreshing. Therefore, it is possible to perform data voltage writing based on the corrected image data corrected by the undershoot circuit 106, immediately at the time of an image update.

2. Second Embodiment

2.1 Partial Intermission Driving

Figure 10:
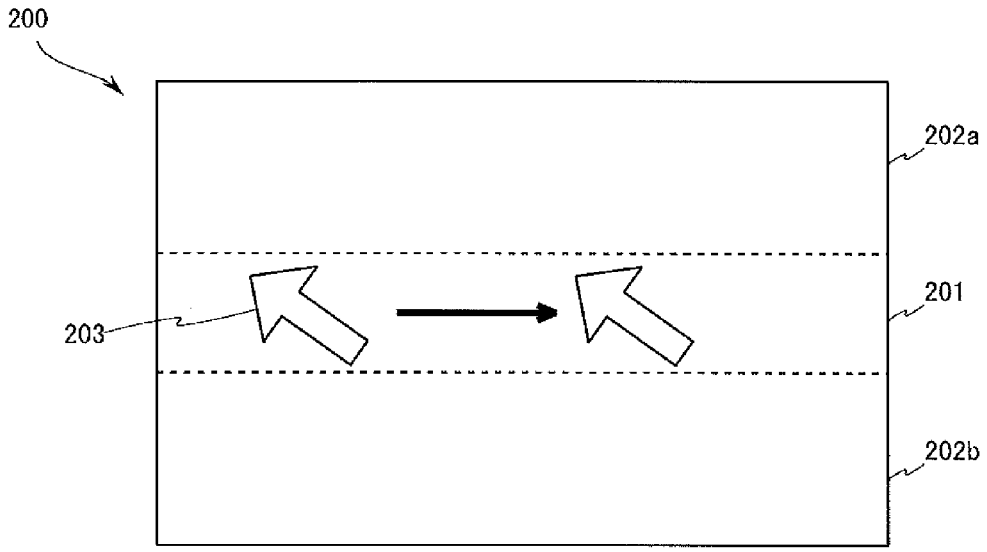
FIG. 10 is a diagram for describing a partial intermission driving.

A discussion will be made here for an arrangement (hereinafter called partial intermission driving") that when part of an image is updated during an intermission period, coercive refreshing is made for regions in the screen which include changed pixels (hereinafter called "updated regions"), whereas the coercive refreshing is not performed and the ongoing intermission period continues for the regions other than the updated regions (hereinafter called "non-updated regions"). FIG. 10 is a diagram for describing the partial intermission driving. In FIG. 10, the vertical direction is the column direction and the horizontal direction is the row direction. In this example, a screen 200 is divided into an updated region 201, and two non-updated regions 202*a*, 202*b* sandwiching the updated region 201 in the column direction. As shown in FIG. 10, the updated region 201 and the non-updated regions 202*a*, 202*b* are identified for each row. In the screen 200, the update of the image causes a pointer symbol 203 to move from left to right in FIG. 10. According to such a partial intermission driving as the above, it is only necessary to refresh part of the image at the time of coercive refreshing, so it is possible to decrease power consumption. The updated region 201 includes both changed pixels and unchanged pixels, and at the time of coercive refreshing, compares with the entire screen according to the first embodiment. In more detailed wording, the updated region 201 is a region constituted by scanning lines GL each connected to pixel formation portions 11 which form the updated region 201 and is a region where these scanning lines GL are taken collectively for sequential selection, at the time of coercive refreshing. Note that the present embodiment also assume, like the first embodiment, that it uses a liquid crystal panel 10 of a normally-black method.

Figure 11:
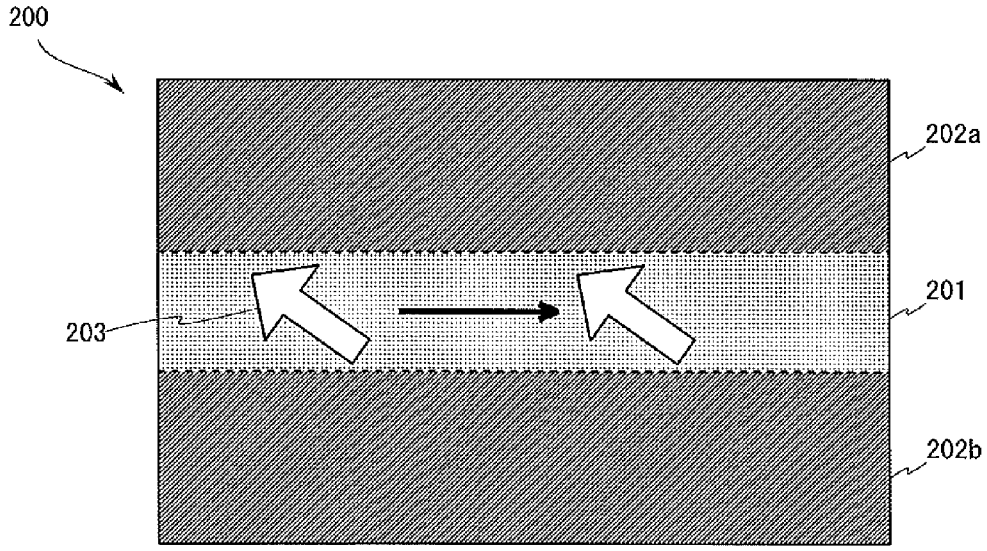
FIG. 11 is a diagram for describing a case where a conventional intermission driving is applied to the partial intermission driving.
Figure 15:
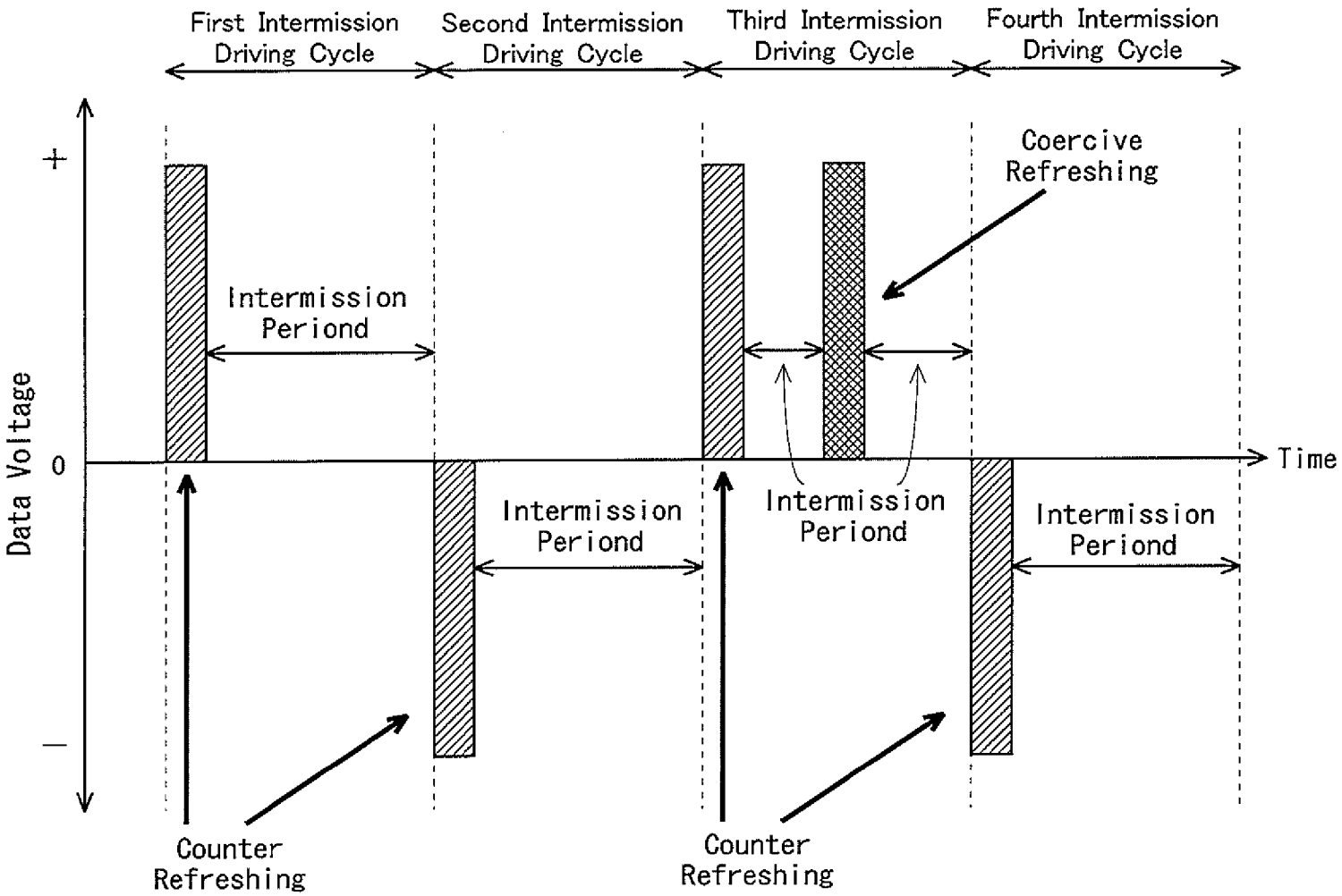
FIG. 15 is a diagram for describing a conventional intermission driving.
Figure 16:
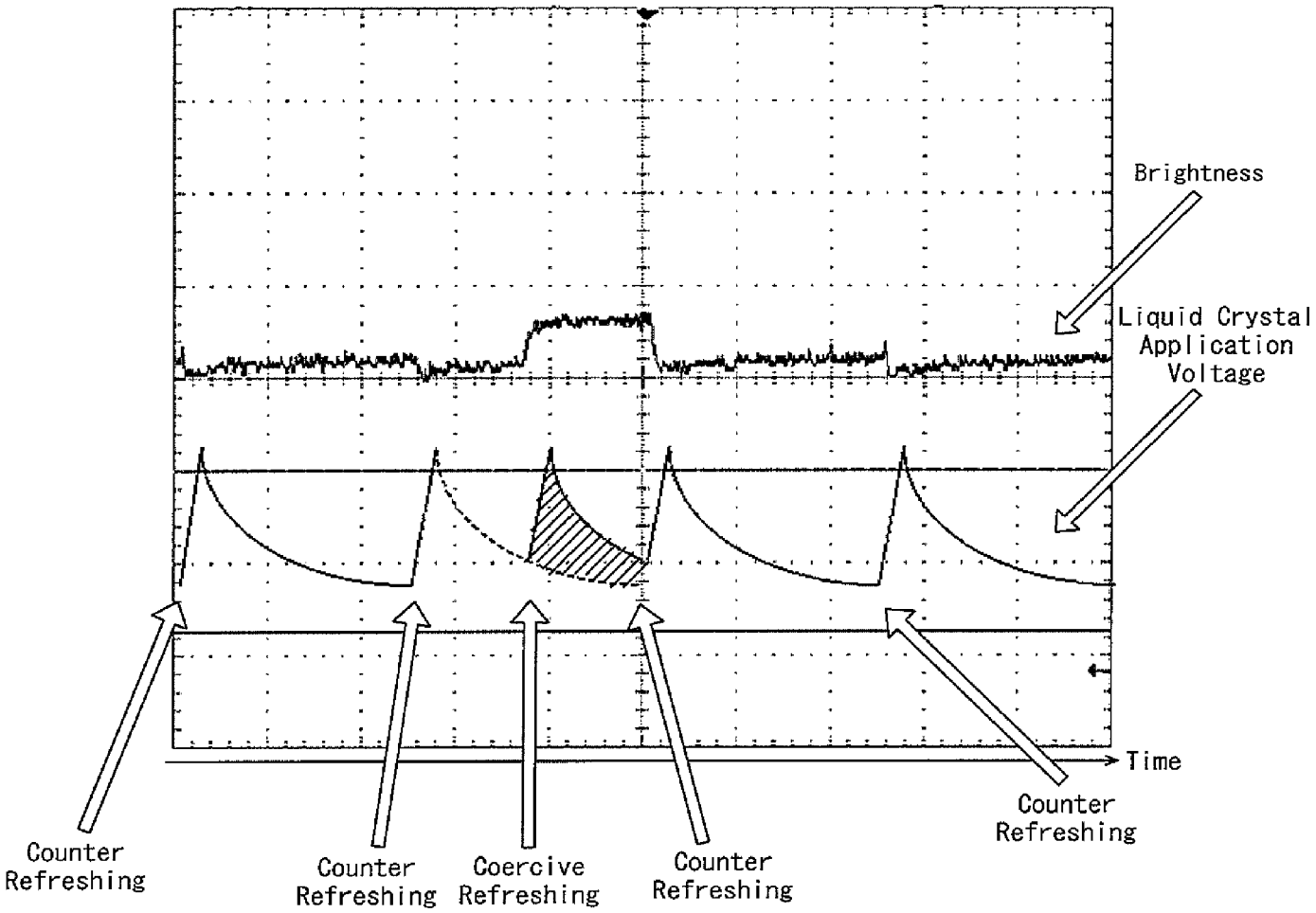
FIG. 16 shows how a liquid crystal application voltage and a brightness change in the conventional intermission driving.

Now, discussion will cover a case where the conventional intermission driving shown in FIG. 15 and FIG. 16 is applied to the partial intermission driving shown in FIG. 10. FIG. 11 is a drawing for describing the case where the conventional intermission driving shown in FIG. 15 and FIG. 16 is applied to the partial intermission driving shown in FIG. 10. Image data indicates an image where all the pixels have the same gradation value, except for those pixels that constitute the pointer symbol 203. When coercive refreshing takes place in the updated region 201 under such a condition as described, each unchanged pixel in the updated region 201, i.e., the liquid crystal capacitance Clc of the pixel formation portion 11, is given the same data voltage of the same polarity and the same magnitude as of the immediately preceding counter refreshing. Therefore, the liquid crystal application voltage increases again, and the effective value of the liquid crystal application voltage increases. As shown in FIG. 11, this causes brightness change in the unchanged pixels, causing the unchanged pixels in the updated region 201 to be displayed more brightly than those in the non-updated regions 202*a*, 202*b*. Therefore, in the second embodiment of the present invention, the intermission driving according to the first embodiment is applied to the partial intermission driving shown in FIG. 10. Hereinafter, the two non-updated regions 202*a*, 202*b* may be indicated simply by a number 202 when they are not differentiated from each other.

2.2 Display Control Circuit

Figure 12:
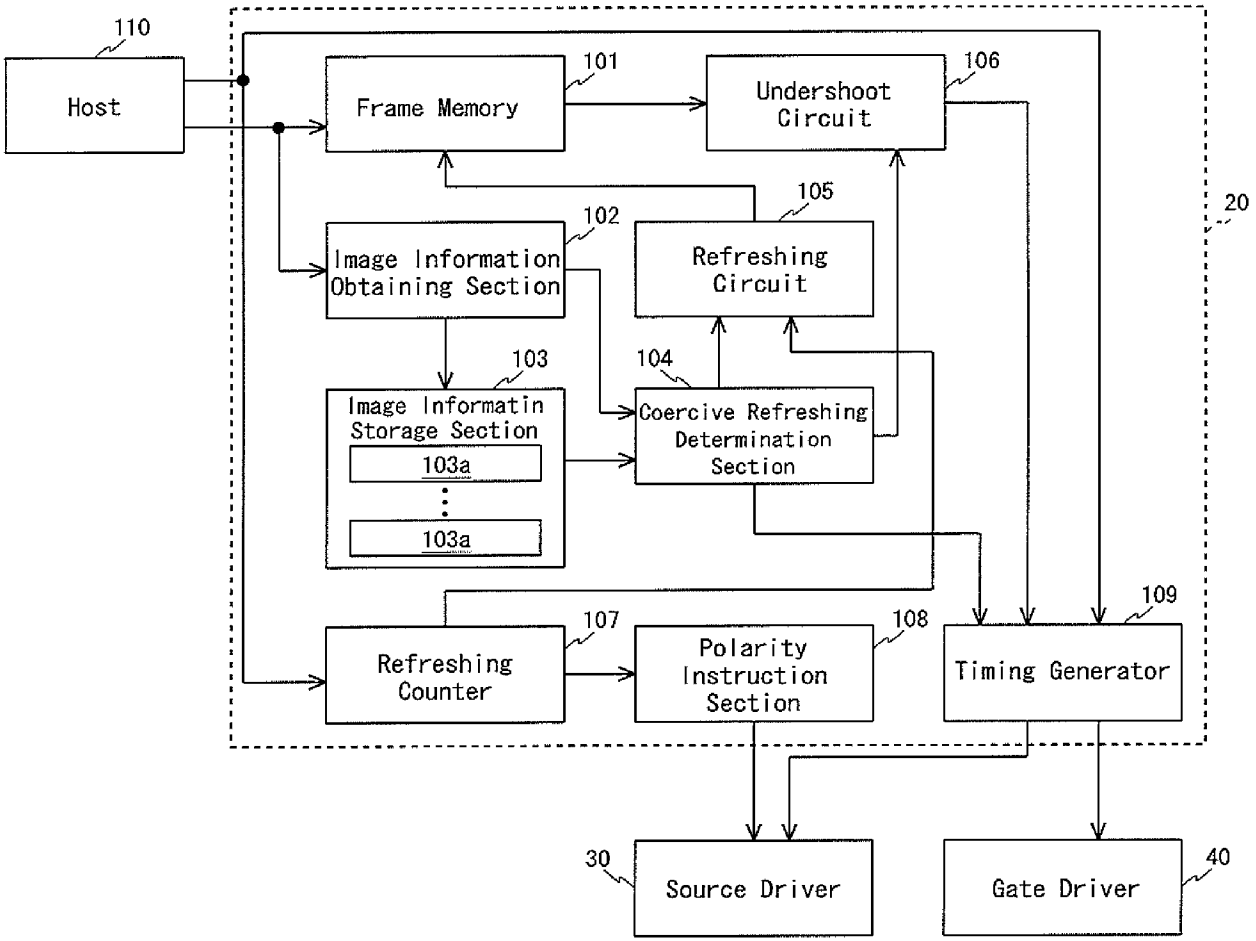
FIG. 12 is a block diagram for describing a configuration of a display control circuit according to a second embodiment of the present invention.

FIG. 12 is a block diagram for describing a configuration of a display control circuit 20 according to the second embodiment of the present invention. Constituent elements of the present embodiment which are identical with those in the first embodiment will be indicated with the same reference symbols, without repeating description thereof when appropriate. The display control circuit 20 in the present embodiment has basically the same configuration as in the first embodiment, but the image information storage section 103 is capable of storing image information for each line. Specifically, as shown in FIG. 12, the image information storage section 103 has per-line image information storage sub-sections 103*a* for storage of one-line amount of image information, as many as the number of scanning lines GL. With the above arrangement included therein, the present embodiment performs counter refreshing identically as the first embodiment, so description hereafter will only cover an operation in coercive refreshing.

The coercive refreshing determination section 104 makes line-by-line comparison between current-frame image information received from the image information obtaining section 102 and previous-frame image information received from the image information storage section 103, and determines that a line is included in the updated region 201 if the comparison reveals difference in image information. At this point, the coercive refreshing determination section 104 outputs an active coercive refreshing signal to the refreshing circuit 105 and outputs an active correction instruction signal to the undershoot circuit 106 like the first embodiment. In this way, determination is made as to whether or not part of the image is updated. The coercive refreshing determination section 104 determines that the line is included in the non-updated region 202 if the current frame and the previous frame have the same image information. The coercive refreshing determination section 104 outputs a region signal, for example, for each line to indicates which of the updated region 201 and the non-updated region 202 the line belongs to, to the timing generator 109. Further, it is desirable that the coercive refreshing determination section 104 outputs the region signal also to the refreshing circuit 105 or to the undershoot circuit 106.

Upon reception of the active coercive refreshing signal from the coercive refreshing determination section 104, the refreshing circuit 105 outputs an active output control signal to the frame memory 101. Also, in cases when the coercive refreshing determination section 104 outputs the region signal to the refreshing circuit 105, the refreshing circuit 105 outputs a region indication signal for causing the frame memory 101 to output part of the image data that represents the updated region 201 (hereinafter called "updated-region data"), to the frame memory 101 together with the active output control signal.

If only the active coercive refreshing signal comes from the refreshing circuit 105, the frame memory 101 outputs one frameful of image data from its storage to the undershoot circuit 106. If the active coercive refreshing signal and the region indication signal come from the refreshing circuit 105, the frame memory 101 outputs updated-region data out of one frameful of image data from its storage, to the undershoot circuit 106.

It is desirable that the undershoot circuit 106 receives only the updated-region data from the frame memory 101 in the case when it receives only the active correction instruction signal from the coercive refreshing determination section 104. In this way it is possible to make gradation value correction only to the updated-region data. In the case when the undershoot circuit 106 receives the active correction instruction signal and the region signal from the coercive refreshing determination section 104, it may receive one frameful of image data or only the updated-region data from the frame memory 101. In this way it is possible to make gradation value correction only to the updated-region data. The undershoot circuit 106 outputs corrected updated-region data to the timing generator 109. It should be noted here that the undershoot circuit 106 may make gradation value correction to the entire frameful of image data, and then output the corrected image data to the timing generator 109. In this case, however, part of the corrected image data representing the non-updated region 202 does not contribute to the refreshing.

Based on the region signal received from the coercive refreshing determination section 104, the timing generator 109 instructs the gate driver 40 to scan those scanning lines (included in the updated region 201). For example, the timing generator 109 outputs the above-mentioned active enable signal to the gate driver 40 for each line, thereby instructing the gate driver 40 which of the scanning lines to be scanned. Specifically, while the gate driver 40 operates its internal shift registers, it operates each buffer amplifier located between the scanning line which must be scanned and the corresponding stage of the shift register whereas it stops the other buffer amplifiers, to implement scanning of the desired scanning lines. However, the method for scanning desired scanning lines is not limited to the one described here, but any conventional methods may be employed appropriately. Based on the updated-region data or image data received from the undershoot circuit 106 and also on the synchronization signal received from the host 110, the timing generator 109 operates the same way as it does in the first embodiment based on image data received from the undershoot circuit 106 and the synchronization signal received from the host 110, so description thereof will not be repeated here. As described above, it is possible to perform coercive refreshing only in the updated region 201 while continuing intermission period in the non-the updated region 201.

2.3 Updated Region

Figure 13:
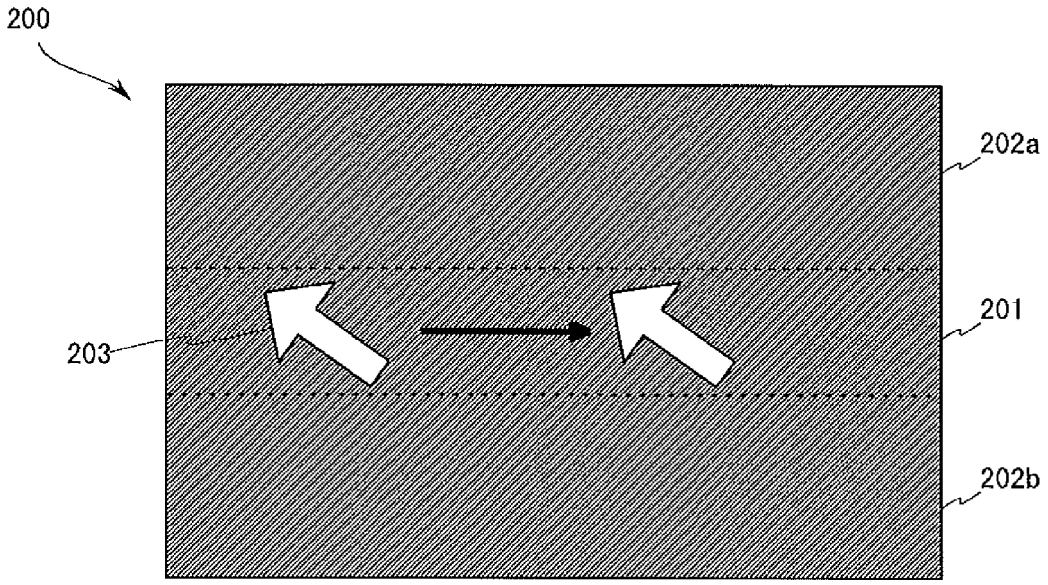
FIG. 13 is a diagram for describing a partial intermission driving according to the second embodiment.

FIG. 13 is a diagram for describing the partial intermission driving according to the present embodiment. In the present embodiment, the updated region 201 undergoes the same driving as in the first embodiment at the time of coercive refreshing. This means that in a coercive refreshing performed in the updated region 201 data voltages to be written to the liquid crystal capacitances Clc in the pixel formation portions 11 of the unchanged pixels within the updated region 201 are closer to the common voltage than data voltages written to the liquid crystal capacitance Clc in the immediately preceding counter refreshing. In other words, smaller liquid crystal application voltages than those used at the time of the immediately preceding counter refreshing are applied to the liquid crystal layer at the time of coercive refreshing. In this way, the arrangement reduces increase in the liquid crystal application voltage at the time of coercive refreshing, and therefore reduces increase in the effective value of the liquid crystal application voltage. Thus, brightness change which can occur in the updated region 201 at the time of image update is suppressed.

2.4 Advantages

According to the present embodiment, it is possible to reduce power consumption more than in the first embodiment by employing partial intermission driving. Also, since the updated region 201 is driven in the same way as in the first embodiment at the time of coercive refreshing, brightness change which can occur in the updated region 201 at the time of image update is suppressed like in the first embodiment. Thus, it is possible as shown in FIG. 13, to suppress brightness difference between the updated region 201 and the non-updated region 202.

3. Third Embodiment

3.1 Brightness Change at the Time of Polarity Inversion

It is known that there is a rapid brightness change immediately after data voltage writing when data voltage polarity is inverted. This is because the liquid crystal molecules cannot follow the change in the alignment direction when data voltage polarity is inversed. Therefore, according to the third embodiment of the present invention, data voltage is overshot at the time of the above-described counter refreshing where polarity is inverted. The present embodiment is applicable to whichever of the driving like in the first embodiment where drive period and intermission period are set universally across the screen, and the driving like in the second embodiment where partial intermission driving is employed. Note that the present embodiment also assume, like the first and the second embodiments, that it uses a liquid crystal panel 10 of a normally-black method.

3.2 Intermission Driving

Figure 14:
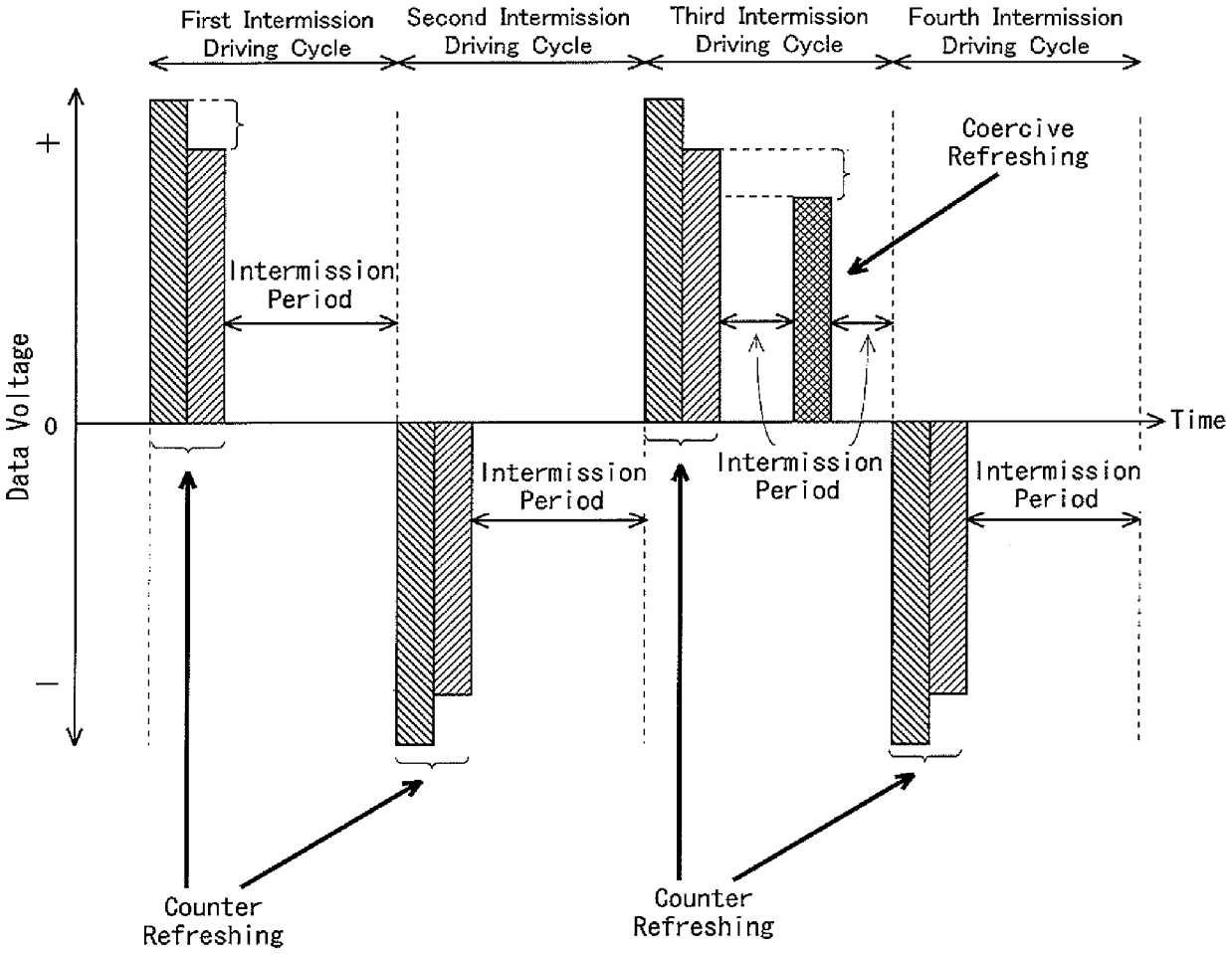
FIG. 14 is a diagram for describing an intermission driving according to a third embodiment of the present invention.

FIG. 14 is a diagram for describing an intermission driving according to the present embodiment. An operation at the time of coercive refreshing is the same as in the first embodiment or the second embodiment described already, and therefore will not be repeated here. In the present embodiment, the drive period at the time of counter refreshing consists of a plurality of drive frames, or more specifically, consists of two drive frames. The first drive frame is an overshoot drive frame for writing overshot data voltages. The overshoot drive frame is followed by a drive frame, or a normal driving frame, for writing normal data voltages which are not overshoot. As a note, the drive period at the time of counter refreshing may consist of three or more drive frames, with two or more (but less than the total number of drive frames for the counter refreshing) drive frames performed as overshoot drive frames. In this case, each overshoot drive frame may use different voltage values.

Gradation value correction for the overshooting can be implemented as follows, using the configuration in the first embodiment (FIG. 3) or in the second embodiment (FIG. 12): For example, the undershoot circuit 106 performs the gradation value correction for the overshooting. In this case, the undershoot circuit 106 functions as an overshoot circuit at the time of overshoot drive frame, receiving image data outputted from the frame memory 101 based on an active output control signal, correcting the received image data by performing an adding operation, and then outputting the corrected image data to the timing generator 109. Specifically, the undershoot circuit 106 increases the gradation values of image data received from the frame memory 101. As a result, data voltages based on the corrected image data have values farther from the common voltage than do data voltages based on the image data received from the frame memory 101. If the common voltage is expressed as 0V, a positive-polarity data voltage is expressed as a positive voltage, and a negative-polarity data voltage as a negative voltage, as described earlier, then the data voltages based on the corrected image data have greater absolute values than absolute values of data voltages based on the image data which are received from the frame memory 101. In other words, the data voltage is overshot. In the normal driving frame, the undershoot circuit 106 outputs the received image data to the timing generator 109 without making corrections. In this way, driving as shown in FIG. 14 is implemented.

It is desirable that the undershoot circuit 106 receives a signal which indicates whether the drive frame during the counter refreshing is an overshoot drive frame or the normal driving frame, from the refreshing circuit 105, the refreshing counter 103 or others. Alternatively, an overshoot circuit may be provided separately from the undershoot circuit 106, to perform gradation value correction for the overshoot circuit to overshoot. In this case, the undershoot circuit 106 and the overshoot circuit constitute the gradation correction circuit.

3.3 Advantages

According to the present embodiment, image data gradation values are corrected in the overshoot drive frame at the time of counter refreshing, and the data voltages are overshot. Therefore, it is possible to suppress brightness change which can occur at the time of polarity-inverting counter refreshing.

4. Others

The present invention is not limited to the embodiments described thus far, but may be varied in many ways within the scope of the present invention. For example, description was made only for cases where coercive refreshing is performed only once in an intermission period; however, coercive refreshing may be performed for a plurality of times in an intermission period. In this case, the first coercive refreshing is performed in the same way as described so far. In the second and the later coercive refreshing, data voltage polarity is the same as in the immediately preceding counter refreshing, like in the first coercive refreshing, but data voltage are set to values closer to the common voltage previous data voltages used in the immediately preceding coercive refreshing, or data voltage values which are more or less the same as used in the immediately preceding coercive refreshing are used.

In each of the embodiments described so far, the liquid crystal panel 10 employs a normally-black method, so gradation value correction performed by the undershoot circuit 106 at the time of coercive refreshing is to decrease the values. However, in cases where a normally-white method is utilized in the liquid crystal panel 10, gradation value correction performed by the undershoot circuit 106 at the time of coercive refreshing is to increase the values. Likewise, in cases where a normally-white method is utilized in the liquid crystal panel 10 for the above-described third embodiment, the undershoot circuit 106 (or the overshoot circuit) performs correction to decrease the gradation values in the overshoot drive frame.

In each of the above-described embodiments, the TFT 12 is provided by an oxide TFT such as a IGZO-TFT; however, the present invention is not limited by this. The TFT 12 may be provided by such a TFT as an amorphous silicon TFT, a microcrystalline silicon TFT, a continuous grain silicon TFT and a low-temperature polysilicon TFT.

Also, the second and the third embodiments may be combined with any of the variations according to the first embodiment.

In each embodiment, description was made for cases where the display device is provided by a liquid crystal display device; however, the present invention is applicable to any other display devices which are capable of performing intermission driving and is capable of stopping each driver during the intermission period.

5. Appendices

Appendix 1

A display device which comprises a display section including pixel formation portions, and performs an intermission driving of alternately repeating a drive period for refreshing a screen of the display section by writing data voltages which are based on externally received image data to the pixel formation portions; and an intermission period for stopping writing of the data voltages to the pixel formation portions, the display device further comprising a driving section configured to write the data voltages to the pixel formation portions; and a display controller configured to provide the drive period at a predetermined timing, and control the driving section so that, when part of an image represented by the externally received image data is updated during the intermission period, the intermission period is aborted and the drive period is performed coercively in an updated region which includes said updated part, wherein the display controller includes:

a polarity instruction section configured to control the driving section so that the data voltages in the coercively provided drive period have a same polarity as the data voltages in an immediately preceding drive period; and a gradation correction section configured to: receive a portion of the image data that represents the updated region; correct pixel gradation values for those pixels included in the updated region but not undergoing changes in gradation values due to the image update so that data voltages to be written to their pixel formation portions in the coercively provided drive period have values closer to a baseline common voltage than do data voltages written to said pixel formation portions in an immediately preceding drive period; and output corrected data that represent the updated region, wherein the driving section writes to the pixel formation portions data voltages which are based on said corrected data that represent the updated region and have undergone the gradation value correction made by the gradation correction section, in the coercively provided drive period, wherein the display section further includes scanning lines connected to the pixel formation portions, and wherein the updated region is a region where the scanning lines each being connected to corresponding ones of the pixel formation portions are taken collectively for sequential selection.

According to the display device disclosed in Appendix 1, it is possible to provide a drive period coercively only to an updated region in the screen (i.e., a region which includes part of the updated image, and more specifically, a region where the scanning lines each connected to corresponding ones of the pixel formation portions are taken collectively for sequential selection) while continuing an ongoing intermission period to the other regions in the screen. This makes it possible to decrease power consumption. Pixels included in the updated region but not having their gradation values changed by the image update have their respective pixel formation portions supplied, through writing, with data voltages that have the same polarity as data voltages written in the immediately preceding drive period but have values closer to the common voltage in the coercively provided drive period, than do the data voltages written in the immediately preceding drive period. The arrangement reduces increase in application voltage in the coercively provided drive period for the pixels included in the updated region but not having their gradation values changed by the image update; therefore, the arrangement also reduces increase in the effective value of the application voltage in the pixel formation portion. Since brightness change is thus prevented from occurring in the updated region at the time of image update, it is possible to suppress brightness difference between the updated region and the other regions.

Appendix 2

A display device which comprises a display section including pixel formation portions, and performs an intermission driving of alternately repeating a drive period for refreshing a screen of the display section by writing data voltages which are based on externally received image data to the pixel formation portion; and an intermission period for stopping writing of the data voltages to the pixel formation portions, the display device further comprising a driving section configured to write the data voltages to the pixel formation portions; and a display controller configured to provide the drive period at a predetermined timing, and control the driving section so that, when an image represented by the externally received image data is updated during the intermission period, the intermission period is aborted and the drive period is performed coercively, wherein the display controller includes:

a polarity instruction section configured to control the driving section so that the data voltages in the coercively provided drive period have a same polarity as of the data voltages in an immediately preceding drive period; and a gradation correction section configured to: receive at least part of the image data; correct pixel gradation values for those pixels which constitute the image updated during the intermission period but do not have their gradation values changed by the image update, so that data voltages to be written to their pixel formation portions in the coercively provided drive period have values closer to a baseline common voltage than do data voltages written to said pixel formation portions in an immediately preceding drive period; and output at least part of corrected image data, wherein the driving section writes to the pixel formation portions data voltages which are based on at least part of said corrected image data that have undergone the gradation value correction made by the gradation correction section, in the coercively provided drive period, wherein the display section further includes data lines and scanning lines connected to the pixel formation portions, and and wherein the pixel formation portion includes a thin film transistor which has its control terminal connected to a corresponding one of the scanning lines, its first conduction terminal connected to a corresponding one of the data line, its second conduction terminal to a pixel electrode to be supplied with the data voltage, and its channel layer formed of an oxide semiconductor.

According to the display device disclosed in Appendix 2, in a display device which performs intermission driving, pixel formation portions which form pixels whose gradation values are not changed by the image update are supplied, by writing in a coercively provided drive period, with data voltages that have the same polarity as of data voltages written in the immediately preceding drive period but have values closer to the common voltage than values of the data voltages written in the immediately preceding drive period. This reduces increase in pixel formation portion application voltage (or liquid crystal application voltage if the display device is provided by a liquid crystal display device) at the time of a coercively provided drive period, and therefore also reduces increase in pixel formation portion application voltage effective value. This makes it possible to suppress potential brightness change at the time of image update. Also, a thin film transistor which has its channel layer formed of an oxide semiconductor is utilized. Since this thin film transistor features a very small off-leak current, pixel electrode potential change is suppressed. This makes it possible to make the intermission period for decreased power consumption.

Appendix 3

The display device according to Appendix 2, wherein the oxide semiconductor contains indium, gallium, zinc, and oxygen as its principal components.

According to the display device disclosed in Appendix 3, the same advantages as offered by Appendix 2 are provided with the use of a thin film transistor which has its channel layer formed of an oxide semiconductor containing indium, gallium, zinc, and oxygen as its primary components.

Appendix 4

A display device which comprises a display section including pixel formation portions, and performs an intermission driving of alternately repeating a drive period for refreshing a screen of the display section by writing data voltages which are based on externally received image data to the pixel formation portions; and an intermission period for stopping writing of the data voltages to the pixel formation portions, the display device further comprising a driving section configured to write the data voltages to the pixel formation portions; and a display controller configured to provide the drive period at a predetermined timing, and control the driving section so that, when an image represented by the externally received image data is updated during the intermission period, the intermission period is aborted and the drive period is performed coercively, wherein the display controller includes:

a polarity instruction section configured to control the driving section so that the data voltages in the coercively provided drive period have a same polarity as of the data voltages in an immediately preceding drive period; and a gradation correction section configured to: receive the image data; correct pixel gradation values for those pixels which constitute the image updated during the intermission period but do not have their gradation values changed by the image update, so that data voltages to be written to their pixel formation portions in the coercively provided drive period have values closer to the common voltage than do data voltages written to said pixel formation portions in an immediately preceding drive period; and output corrected image data, an image data storage section configured to store externally received one frameful of image data;

a first refreshing controller configured to output an active first refreshing signal and an active polarity inversion signal at the predetermined timing; and a refreshing section configured to cause output of image data stored in the image data storage section, from the image data storage section to the gradation correction section based on the active first refreshing signal, wherein the drive period provided at the predetermined timing includes a plurality of drive frames, wherein the gradation correction section: receives image data which is outputted from the image data storage section based on the active first refreshing signal; corrects pixel gradation values of the image data so that data voltages to be written to the pixel formation portions in at least the first drive frame of the drive period which are provided at the predetermined timing have values farther from the common voltage than do data voltages based on the image data outputted from the image data storage section; and outputs corrected image data, wherein the polarity instruction section causes the driving section to invert the data voltage polarity based on the active polarity inversion signal, and and wherein the driving section writes the data voltage which is based on the image data outputted from the gradation correction section, to the pixel formation portion.

According to the display device disclosed in Appendix 4, in a display device which performs intermission driving involving a drive period and an intermission period uniformly set in a screen, pixel formation portions which form pixels whose gradation values are not changed by the image update are supplied, by writing performed in a coercively provided drive period, with data voltages that have the same polarity as of data voltages written in the immediately preceding drive period but have values closer to the common voltage than values of the data voltages written in the immediately preceding drive period. This reduces increase in pixel formation portion application voltage (or liquid crystal application voltage if the display device is provided by a liquid crystal display device) at the time of a coercively provided drive period, and therefore also reduces increase in pixel formation portion application voltage effective value. This makes it possible to suppress potential brightness change at the time of image update. Also, it is possible to perform refreshing by following the first refreshing signal thereby writing to pixel formation portions data voltages which are based on image data stored in the frame memory in the drive period provided at the predetermined timing. This makes it possible to periodically bring the pixel formation portion application voltages, which change with time during the intermission period, back to the original values. This keeps the image displayed in the screen. Also, it is possible to ensure polarity balance by determining data voltage polarity based on the polarity inversion signal, for each drive period which is provided at the predetermined timing. Also, gradation values are corrected so that data voltages to be written to the pixel formation portions have values farther from the common voltage than do data voltages based on the image data outputted from the image data storage section in at least the first drive frame of the drive period which is provided at the predetermined timing. This suppresses brightness change which can occur in the drive period which is provided at a predetermined timing.

Appendix 5

A display device which comprises a display section including pixel formation portions, and performs an intermission driving of alternately repeating a drive period for refreshing a screen of the display section by writing data voltages which are based on externally received image data to the pixel formation portions; and an intermission period for stopping writing of the data voltages to the pixel formation portions, the display device further comprising a driving section configured to write the data voltages to the pixel formation portions; and a display controller configured to provide the drive period at a predetermined timing, and control the driving section so that, when part of an image represented by the externally received image data is updated during the intermission period, the intermission period is aborted and the drive period is performed coercively in an updated region which includes said updated part, wherein the display controller includes:

a polarity instruction section configured to control the driving section so that the data voltages in the coercively provided drive period have a same polarity as of the data voltages in an immediately preceding drive period; and a gradation correction section configured to: receive a portion of the image data that represents the updated region; correct pixel gradation values for those pixels included in the updated region but not undergoing changes in gradation values due to the image update so that data voltages to be written to their pixel formation portions in the coercively provided drive period have values closer to a baseline common voltage than do data voltages written to said pixel formation portions in an immediately preceding drive period; and output corrected data that represent the updated region, an image data storage section configured to store externally received one frameful of image data;

a first refreshing controller configured to output an active the first refreshing signal at the predetermined timing; and a refreshing section configured to cause output of image data stored in the image data storage section, from the image data storage section to the gradation correction section based on the active first refreshing signal, wherein the driving section supplies the pixel formation portions with data voltages which are based on said corrected data that represent the updated region and have undergone the gradation value correction made by the gradation correction section, in the coercively provided drive period, wherein the drive period provided at the predetermined timing includes a plurality of drive frames, wherein the gradation correction section: receives image data which is outputted from the image data storage section based on the active first refreshing signal; corrects pixel gradation values of the image data so that data voltages to be written to the pixel formation portions in at least the first drive frame of the drive period which are provided at the predetermined timing have values farther from the common voltage than do data voltages based on the image data outputted from the image data storage section; and outputs corrected image data, and wherein the driving section writes the data voltage which is based on the image data outputted from the gradation correction section or based on data representing the updated region, to the pixel formation portion.

The display device disclosed in Appendix 5 provides the same advantages as offered by the display device according to Appendix 4, in the arrangement that, at the time of image update, a drive period is provided coercively only for updated regions in the screen, and an intermission period is continued for the other regions in the screen.

INDUSTRIAL APPLICABILITY

The present invention is applicable to display devices which perform intermission driving, and methods of driving these display devices.

LEGENDS

10 Liquid Crystal Panel (Display Section)
11 Pixel formation portion
12 TFT
13 Pixel Electrode
14 Common Electrode
20 Display Control Circuit (Display Controller)
30 Source Driver
40 Gate Driver
50 Vcom Driver
100 Liquid Crystal Display Device
101 Frame Memory (Image Data Storage Section)
102 Image Information Obtaining Section
103 Image Information Storage Section
103*a* Per-Line Image Information Storage Sub-Sections
104 Coercive Refreshing Determination Section (Second Refreshing Controller)
105 Refreshing Circuit (Refreshing Section)
106 Undershoot Circuit (Gradation Correction Section)
107 Refreshing Counter (First Refreshing Controller)
107*a* Internal Clock Generation Circuit
108 Polarity Instruction Section
109 Timing Generator
110 Host
200 Screen
201 Updated Region
202*a*, 202*b* Non-Updated Regions
203 Pointer Symbol
Clc Liquid Crystal Capacitance
Gl Scanning Lines
Sl Data Line

The invention claimed is:

1. A display device which comprises a display section including pixel formation portions, and performs an intermission driving of alternately repeating a drive period for refreshing a screen of the display section by writing data voltages which are based on externally received image data to the pixel formation portions; and an intermission period for stopping writing of the data voltages to the pixel formation portions, the display device further comprising a driving section configured to write the data voltages to the pixel formation portions; and a display controller configured to provide the drive period at a predetermined timing, and control the driving section so that, when an image represented by the externally received image data is updated during the intermission period, the intermission period is aborted and the drive period is performed coercively, wherein the display controller includes:

a polarity instruction section configured to control the driving section so that the data voltages in the coercively provided drive period have a same polarity as of the data voltages in an immediately preceding drive period; and a gradation correction section configured to: receive at least part of the image data; correct pixel gradation values for those pixels which constitute the image which is updated during the intermission period but do not have their gradation values changed due to the image update, so that data voltages to be written to their pixel formation portions in the coercively provided drive period have values closer to a baseline common voltage than do data voltages written to said pixel formation portions in an immediately preceding drive period; and output at least part of corrected image data, and wherein the driving section writes to the pixel formation portions data voltages which are based on at least part of said corrected image data that have undergone the gradation value correction made by the gradation correction section, in the coercively provided drive period.

2. The display device according to claim 1, wherein the gradation correction section receives the image data; corrects pixel gradation values for those pixels which constitute the image updated during the intermission period but do not have their gradation values changed by the image update so that data voltages to be written to their pixel formation portions in the coercively provided drive period have values closer to the common voltage than do data voltages written to said pixel formation portions in an immediately preceding drive period; and outputs corrected image data, and wherein the driving section writes to the pixel formation portions data voltages which are based on the image data that have undergone the gradation value correction made by the gradation correction section, in the coercively provided drive period.

3. The display device according to claim 2, wherein the display controller further includes:

an image data storage section configured to store externally received one frameful of image data;

a first refreshing controller configured to output an active first refreshing signal and an active polarity inversion signal at the predetermined timing; and a refreshing section configured to cause output of image data stored in the image data storage section, from the image data storage section to the gradation correction section based on the active first refreshing signal, wherein the gradation correction section outputs the image data outputted from the image data storage section based on the active first refreshing signal, without correcting gradation values, and wherein the polarity instruction section causes the driving section to invert the data voltage polarity based on the active polarity inversion signal.

4. The display device according to claim 3, wherein the display controller further includes:

a second refreshing controller configured to output an active second refreshing signal and an active correction instruction signal when an image represented by externally received image data is updated during the intermission period, wherein the refreshing section causes output of image data stored in the image data storage section, from the image data storage section to the gradation correction section based on the active second refreshing signal, and wherein the gradation correction section corrects gradation values of the image data received from the image data storage section, based on the active correction instruction signal.

5. The display device according to claim 4, wherein the display controller includes:

an image information obtaining section configured to obtain information of an image represented by externally received one frameful of image data, and output the obtained information of the image, and an image information storage section configured to store the information of the image obtained by the image information obtaining section, and wherein the second refreshing controller compares the information of the image in a current frame obtained by the image information obtaining section and the information of the image in a previous frame stored in the image information storage section to each other, and outputs the active second refreshing signal if the information of the image in the current frame differs from the information of the image in the previous frame.

6. The display device according to claim 5, wherein the image information obtaining section takes a sum of gradation values in externally received one frameful of image data, as the information of the image.

7. The display device according to claim 5, wherein the image information obtaining section takes a histogram of gradation values in externally received one frameful of image data, as the information of the image.

8. The display device according to claim 5, wherein the image information obtaining section takes externally received one frameful of image data, as the information of the image.

9. The display device according to claim 3, wherein the first refreshing controller determines the predetermined timing based on an externally received synchronization signal.

10. The display device according to claim 3, wherein the display controller receives the image data externally only at a time of image update.

11. The display device according to claim 10, wherein the first refreshing controller internally generates a clock signal, and determines the predetermined timing based on the clock signal.

12. The display device according to claim 3, wherein the gradation correction section receives the image data externally in the coercively provided drive period.

13. The display device according to claim 1, wherein the display controller controls the driving section, when part of an image represented by externally received image data is updated during the intermission period, so as to abort the intermission period in an updated region which includes the updated part and provide the drive period coercively, the gradation correction section receives a portion of the image data which represents the updated region; corrects pixel gradation values for those pixels included in the updated region but not having their gradation values changed by the image update so that data voltages to be written to their pixel formation portions in the coercively provided drive period have values closer to the common voltage than do data voltages written to said pixel formation portions in an immediately preceding drive period; and outputs corrected data that represent the updated region, and the driving section writes to the pixel formation portions data voltages which are based on data which represent the updated region and have undergone the gradation value correction made by the gradation correction section, in the coercively provided drive period.

14. The display device according to claim 13, wherein the display controller further includes:

an image data storage section configured to store externally received one frameful of image data;

a first refreshing controller configured to output an active first refreshing signal and an active polarity inversion signal at the predetermined timing; and a refreshing section configured to cause output of image data stored in the image data storage section, from the image data storage section to the gradation correction section based on the active first refreshing signal, wherein the gradation correction section outputs the image data outputted from the image data storage section based on the active first refreshing signal, without correcting gradation values, and wherein the polarity instruction section causes the driving section to invert the data voltage polarity based on the active polarity inversion signal.

15. The display device according to claim 14, wherein the display controller further includes a second refreshing controller configured to output an active second refreshing signal and an active correction instruction signal when the part of the image represented by externally received image data is updated during the intermission period, wherein the refreshing section causes output of data which represents the updated region and is part of the image data stored in the image data storage section, from the image data storage section to the gradation correction section based on the active second refreshing signal, the gradation correction section corrects gradation values of the data which represents the updated region and is received from the image data storage section, based on the active correction instruction signal.

16. A driving method of a display device which comprises a display section including pixel formation portions, and performs an intermission driving of alternately repeating a drive period for refreshing a screen of the display section by writing data voltages which are based on externally received image data to the pixel formation portions, and an intermission period for stopping writing of the data voltages to the pixel formation portions, the method comprising:

a writing step of aborting the intermission period and providing the drive period coercively when an image represented by externally received image data is updated during the intermission period, thereby writing the data voltages to the pixel formation portions in the coercively provided drive period, with a same data voltage polarity as in an immediately preceding drive period; and a gradation correction step of receiving at least part of the image data; correcting pixel gradation values for those pixels which constitute the image which is updated during the intermission period but do not have their gradation values changed due to the image update, so that data voltages to be written to their pixel formation portions in the coercively provided drive period have values closer to a baseline common voltage than do data voltages written to said pixel formation portions in an immediately preceding drive period; and outputting at least part of corrected image data, wherein in the writing step, to the pixel formation portions are written data voltages which are based on at least part of the corrected image data that have undergone the gradation value correction made in the gradation correction step.

* * * * *